US007970335B2

(12) United States Patent
Kurihara

(10) Patent No.: US 7,970,335 B2
(45) Date of Patent: Jun. 28, 2011

(54) CLEANING DEVICE AND IMAGE FORMING APPARATUS

(75) Inventor: Kazuteru Kurihara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 325 days.

(21) Appl. No.: 12/379,649

(22) Filed: Feb. 26, 2009

(65) Prior Publication Data

US 2009/0220286 A1 Sep. 3, 2009

(30) Foreign Application Priority Data

Feb. 28, 2008 (JP) ..... 2008-047482

(51) Int. Cl.
*G03G 21/00* (2006.01)

(52) U.S. Cl. ..... 399/350

(58) Field of Classification Search ..... 399/107, 399/110, 123, 343, 350, 351; 15/256.5, 256.51, 15/256.52
See application file for complete search history.

(56) References Cited

U.S. PATENT DOCUMENTS

| | | | | |
|---|---|---|---|---|
| 4,937,633 | A * | 6/1990 | Ewing | 399/34 |
| 6,125,257 | A * | 9/2000 | Sekine et al. | 430/119.81 |
| 7,620,357 | B2 * | 11/2009 | Shakuto et al. | 399/350 |
| 7,715,778 | B2 * | 5/2010 | Sugimoto | 399/350 |
| 7,899,382 | B2 * | 3/2011 | Hozumi et al. | 399/346 |

FOREIGN PATENT DOCUMENTS

JP 2003-005434 1/2003

* cited by examiner

*Primary Examiner* — Hoan Tran
(74) *Attorney, Agent, or Firm* — Rabin & Berdo, PC

(57) ABSTRACT

A cleaning device includes a blade disposed so as to contact an image bearing body that bears a developer image. The blade scrapes off a developer adhering to the image bearing body. The blade has an edge portion including first and second surfaces, and is configured so that a distance between the first and second surfaces decreases toward a tip of the edge portion. The first and second surfaces form a predetermined edge angle at the tip of the edge portion. An area of the first surface is smaller than an area of the second surface, and the first surface contacts the image bearing body.

9 Claims, 16 Drawing Sheets

COMPARISON EXAMPLE

COMPARISON EXAMPLE

COMPARISON EXAMPLE

REFERENCE EXAMPLE

REFERENCE EXAMPLE

REFERENCE EXAMPLE

REFERENCE EXAMPLE

FIG.16A
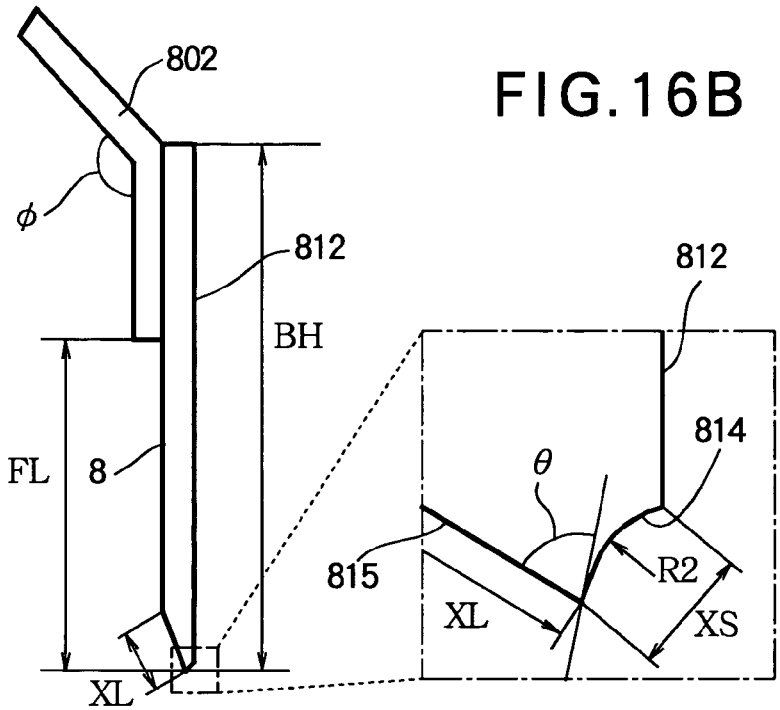
FIG.16B
FIG.17A
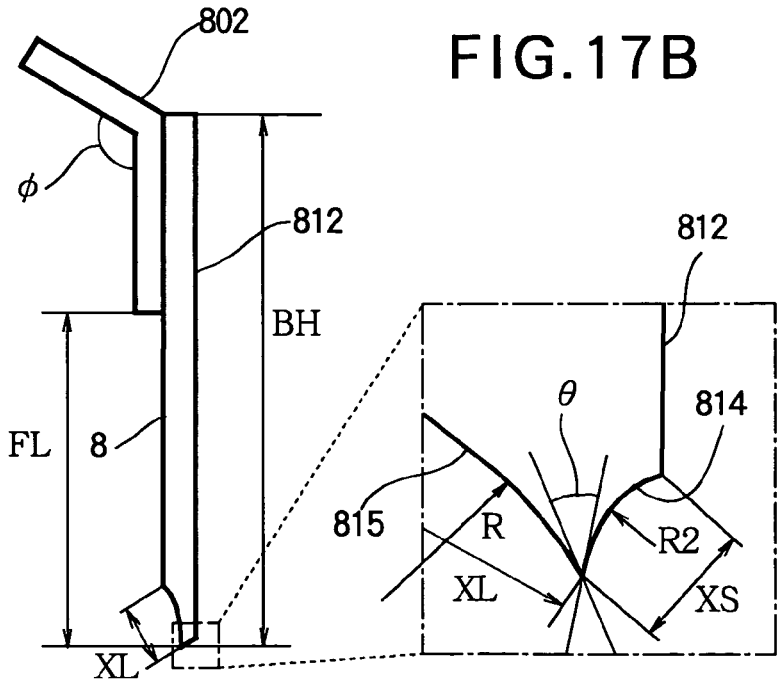
FIG.17B

FIG.20A
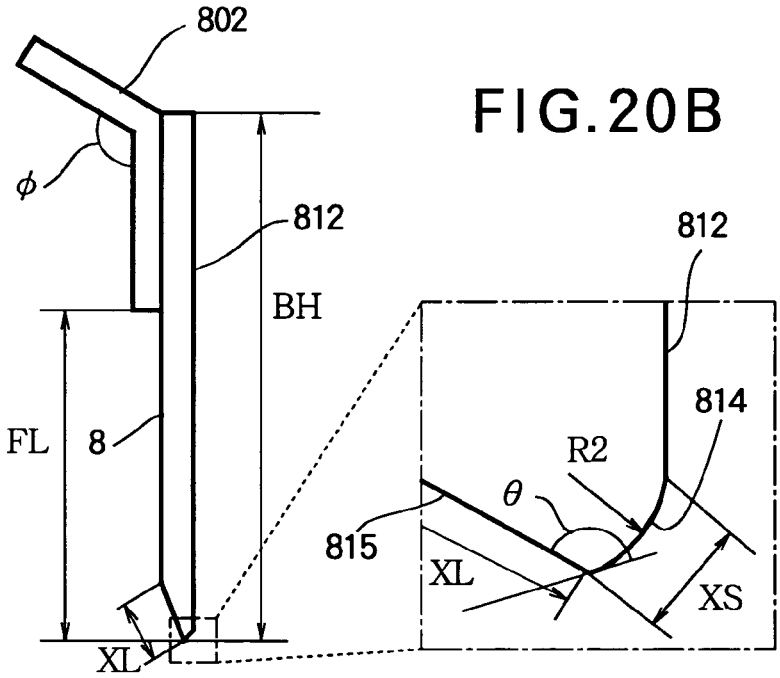
FIG.20B
FIG.21A
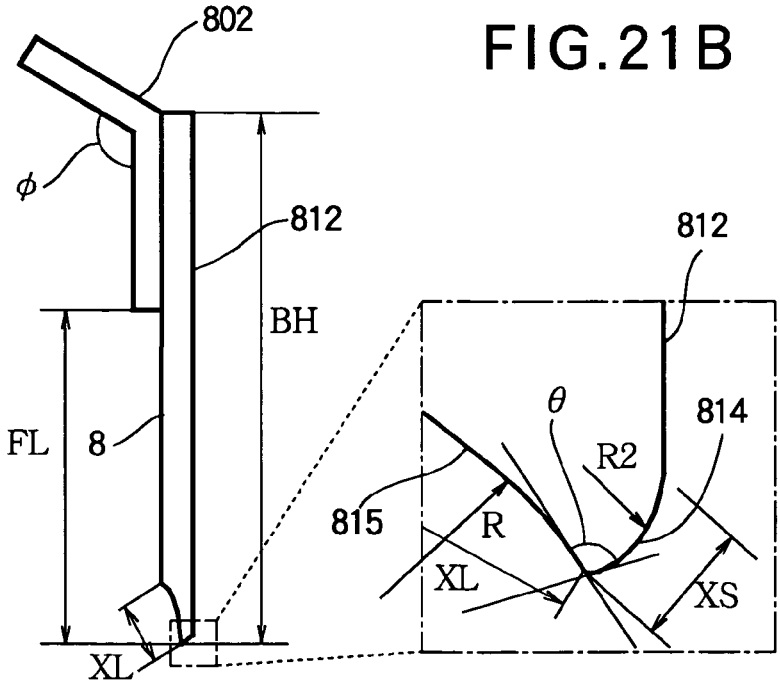
FIG.21B

CLEANING DEVICE AND IMAGE FORMING APPARATUS

BACKGROUND OF THE INVENTION

The present invention relates to a cleaning device for cleaning a toner in an electrophotographic image forming apparatus such as a printer, a facsimile machine or a copier, and also relates to an image forming apparatus having the cleaning device.

In an electrophotographic image forming method, an image is formed through a charging process, an exposing process, a developing process, a transferring process, a fixing process and a cleaning process. Recently, with the increasing demand for higher precision and reproduction of image quality, a spherical toner has become widely used instead of a pulverized toner. The spherical toner exhibits more excellent transferring efficiency than the pulverized toner, and facilitates attaining high resolution. However, the spherical toner has a smooth surface, and is less likely to be caught by a cleaning blade, compared with the pulverized toner. Therefore, the spherical toner is more likely to pass through the cleaning blade, and adhere to a surface of a charging member, which causes a deterioration of image quality. In order to enable cleaning of the spherical toner in the electrophotographic image forming method, there is proposed a developer obtained by mixing a spherical toner and indeterminate-shape particles (see, Japanese Laid-open Patent Publication No. 2003-5434).

SUMMARY OF THE INVENTION

The present invention is intended to provide a cleaning device and an image forming apparatus capable of attaining excellent cleaning performance by reducing the possibility that a developer moves into between a blade and an image bearing body, so as to prevent the developer from passing through the blade even when a spherical toner is used as the developer.

The present invention provides a cleaning device including a blade disposed so as to contact an image bearing body that bears a developer image. The blade scrapes off a developer adhering to the image bearing body. The blade has an edge portion including first and second surfaces, and is configured so that a distance between the first and second surfaces decreases toward a tip of the edge portion. The first and second surfaces form a predetermined edge angle at the tip of the edge portion. An area of the first surface is smaller than an area of the second surface, and the first surface contacts the image bearing body.

With such an arrangement, it becomes possible to reduce possibility that a developer moves into between the blade and the image bearing body. Therefore, even when a spherical toner is used as the developer, the developer is prevented from passing through the blade, with the result that an excellent cleaning performance is obtained.

Since the excellent cleaning performance is obtained without the need for, for example, a developer containing indeterminate-shape particles as disclosed in Japanese Laid-open Patent Publication No. 2003-5434, a white streak or the like (that may appear depending on the content or size of the indeterminate-shape particles) can be prevented. As a result, an excellent cleaning performance and a sufficient image quality are obtained.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 16A is a cross-sectional view showing a cleaning device according to Embodiment 3;

FIG. 16B is an enlarged view showing a part in FIG. 16A;

FIG. 17A is a cross-sectional view showing another configuration of the cleaning device according to Embodiment 3;

FIG. 17B is an enlarged view showing a part in FIG. 17A;

FIG. 20A is a cross-sectional view showing a cleaning device according Embodiment 4;

FIG. 20B is an enlarged view showing a part in FIG. 20A;

FIG. 21A is a cross-sectional view showing another configuration of the cleaning device according to Embodiment 4;

FIG. 21B is an enlarged view showing a part in FIG. 21A;

DETAILED DESCRIPTION OF THE PREFERRED EMBODIMENT

Hereinafter, embodiments and examples of the present invention will be described with reference to the attached drawings.

Embodiment 1

Figure 1:
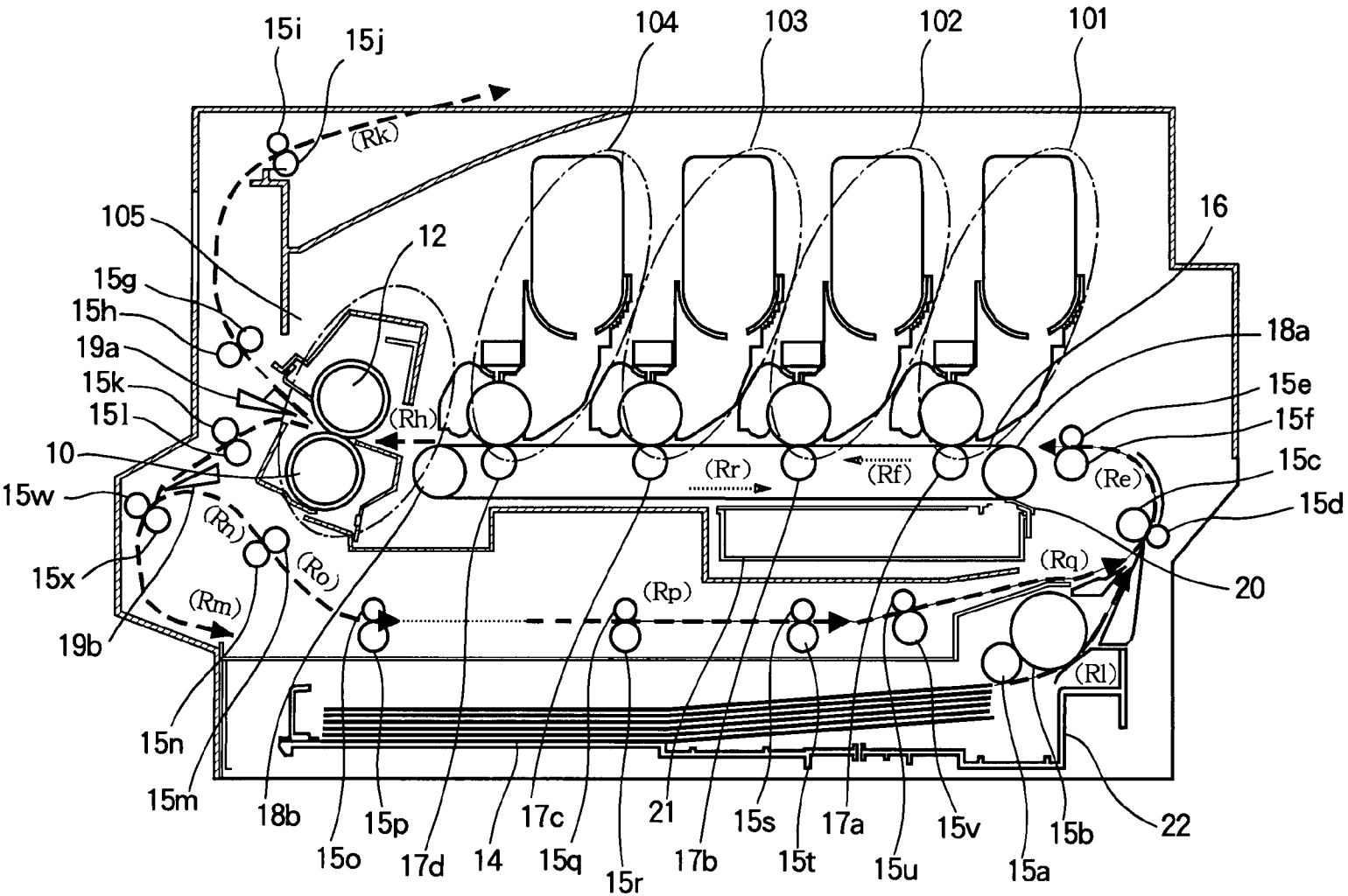
FIG. 1 is a side sectional view schematically showing a configuration of an image forming apparatus employing a cleaning device according to embodiments of the present invention.

FIG. 1 is a side sectional view schematically showing a configuration of an image forming apparatus employing a cleaning device according to Embodiment 1 of the present invention. The image forming apparatus includes sheet feeding rollers 15*a*, 15*b*, 15*c*, 15*d*, 15*e*, 15*f*, 15*g*, 15*h*, 15*i* and 15*j* disposed so as to define a sheet feeding path. Developing devices 101, 102, 103 and 104 are arranged along the sheet feeding path. A fixing device 105 is disposed on a downstream side of the developing devices 101 through 104 along the sheet feeing path. A transfer belt 16 is disposed so as to face the developing devices 101, 102, 103 and 104. Transferring rollers 17*a*, 17*b*, 17*c* and 17*d* are disposed so as to sandwich the transfer belt 16 between the transferring rollers 17*a* through 17*d* and the developing devices 101 through 104. Driving rollers 18*a* and 18*b* is disposed so that the transfer belt 16 is stretched around the driving rollers 18*a* and 18*b*. Sheet feeding guides 19*a* and 19*b* are disposed on a downstream side of the fixing device 105. A belt-cleaning blade 20 is disposed so as to contact the transfer belt 16. A waste developer storage tank 21 is disposed below the transfer belt 16. A sheet feeding cassette 22 is disposed on a lower part of the image forming apparatus.

A recording sheet (i.e., a recording medium) 14 is picked up one by one from the sheet feeding cassette 22, and is fed along the sheet feeding path by the sheet feeding rollers 15*a*, 15*b*, 15*c*, 15*d*, 15*e* and 15*f* (as indicated by arrows Rl, Rq and Re), and reaches the transfer belt 16. The transfer belt 16 moves (as indicated by arrows Rf and Rr) to feed the recording sheet 14 through the developing devices 101 through 104 in this order. As the recording sheet 14 passes through the developing devices 101 through 104 (as indicated by arrows Rf), images of respective colors are formed on the recording sheet 14, so that a color image is formed. After the color image is formed on the recording sheet 14, the recording sheet 14 is fed to the fixing device 105 (as indicated by arrows Rh) where the color image is fixed to the recording sheet 14. After the color image is fixed to the recording sheet 14, the recording sheet 14 is ejected to the outside by the sheet feeding rollers 15*g*, 15*h*, 15*i* and 15*j* (as indicated by arrow Rk). In this regard, if a double-side printing mode is selected, the recording sheet 14 is introduced to a return path by the sheet feeding guide 19*a*, is reversed by the sheet feeding rollers 15*w* and 15*x* and the sheet feeding guide 19*b* (as indicated by arrows Rm and Rn), and is fed along the return path by the sheet feeding rollers 15*p*, 15*q*, 15*r*, 15*s*, 15*t*, 15*u*, 15*v* (as indicated by arrows Ro, Rp and Rq).

The developing devices 101 through 104 have the same configuration except the developer (i.e., toner) used in the respective developing devices 101 through 104.

The fixing device 105 includes a heat roller 12 and a pressure roller 10. The heat roller 12 has a surface heated by a not shown heater applied with electricity by a not shown power source, and heats a toner 6 having been transferred to the recording sheet 14 so as to melt the toner 6. The pressure roller 10 presses the molten toner 6 onto the recording sheet 14.

The heat roller 12 is composed of a hollow cylindrical metal core made of aluminum, a heat-resistant resilient layer made of silicone rubber covering the metal core, and a PFA (tetra-fluoroethylene perfluoro alkyl vinyl ether copolymer) tube covering the heat-resistant resilient layer.

The pressure roller 10 is composed of a metal core made of aluminum, a heat-resistant resilient layer made of silicone rubber covering the metal core, and a PFA tube covering the heat-resistant resilient layer. A nip portion is formed between the pressure roller 10 and heat roller 12.

The fixing device 105 further includes a heater composed of a halogen lamp disposed in the metal core of the heat roller 12, and a thermistor disposed in the vicinity of the heat roller 12 in non-contact manner as a detecting unit of a surface temperature of the heat roller 12.

Figure 2:
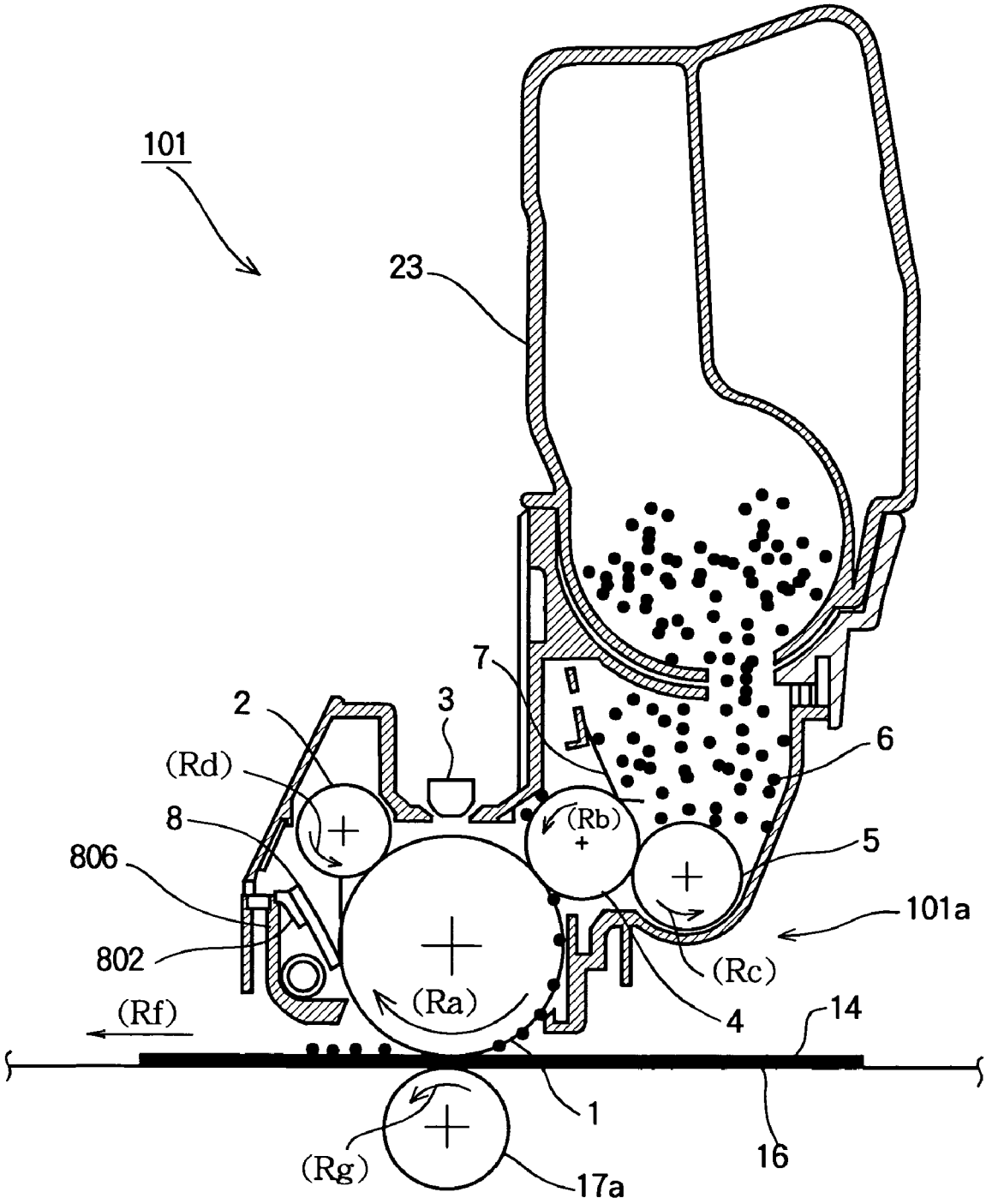
FIG. 2 is an enlarged sectional view showing a developing device of the image forming apparatus shown in FIG. 1.

FIG. 2 is an enlarged sectional view showing the developing device 101 of the image forming apparatus shown in FIG. 1.

The developing device shown in FIG. 2 includes a toner cartridge 23 as a developer cartridge, a photosensitive drum 1 as a latent image bearing body (or an image bearing body), a charging roller 2 as a charging device, an LED head 3 as an exposing device, a developing roller 4 as a developer bearing body, a toner supply roller 5 as a developer storing/recovering body, a developing blade 7 as a developer regulating member, a transferring roller 17*a* and a cleaning blade 8 (i.e., a blade) as a developer recovering device.

The toner cartridge 23 stores the toner 6.

The photosensitive drum 1 is composed of a conductive supporting body and a photoconductive layer covering the conductive supporting body. The conductive supporting body is formed of a metal pipe made of aluminum. The photoconductive layer is formed of an organic photosensitive body in which an electric charge generation layer and an electric charge transporting layer are laminated. The photosensitive drum 1 rotates in a direction shown by arrow Ra in FIG. 2.

The charging roller 2 is composed of a metal shaft and a semiconductive epichlorohydrin rubber layer covering the metal shaft. The charging roller 2 rotates in a direction shown by arrow Rd contacting the photosensitive drum 1. The charging roller 2 is applied with a voltage by a not shown power source, and functions as the charging device for uniformly charging the surface of the photosensitive drum 1. In this regard, the charging roller 2 can be replaced with a non-contact type charging device such as scorotron or corotron.

The LED head 3 is disposed so as to face the photosensitive drum 1. The LED head 3 forms a latent image on the surface of the photosensitive drum 1 having been uniformly charged by the charging roller 2. In this regard, the LED head can be replaced with a laser head or the like.

The developing roller 4 is composed of a metal shaft and a semiconductive urethane rubber layer covering the metal shaft. The developing roller 4 is disposed so as to contact the photosensitive drum 1 or is disposed in the vicinity of the photosensitive drum 1 in noncontact manner. The developing roller 4 rotates in a direction shown by arrow Rb, and carries the toner 6 (i.e., developer) to a developing region to cause the toner 6 to selectively adhere to the photosensitive drum 1 according to the latent image, i.e., to develop (visualize) the latent image as a toner image. That is, the developing roller 4 functions as the developer bearing body.

The toner supplying roller 5 is composed of a metal shaft and a semiconductive foamed silicone sponge layer covering the metal shaft. The toner supplying roller 5 is disposed so as to contact the photosensitive drum 1 or is disposed in the vicinity of the photosensitive drum 1 in noncontact manner. The toner supplying roller 5 rotates in a direction shown by arrow Rc, and supplies the toner 6 (i.e., developer) to the developing roller 4.

The developing blade 7 is made of stainless steel. The developing blade 7 regulates a thickness of a layer of the toner 6 on the developing roller 4 (having been supplied by the toner supplying roller 5), so as to form a toner thin layer on the developing roller 4.

The developing roller 4, the toner supplying roller 5 and the developing blade 7 form a developing portion 101*a*.

The transferring roller 17*a* is disposed so as to contact the photosensitive drum 1 and rotates in a direction shown by arrow Rg. The transferring roller 17*a* is applied with a voltage by a not shown power source, and transfers the toner image (i.e., visualized image) on the photosensitive drum 1 to the recording sheet 14 as a recording medium (such as paper and OHP sheet) fed in a direction shown by arrow Rf. That is, the transferring roller 17*a* functions as a transferring device. In this regard, the transferring roller 17*a* can be replaced with a transferring device of a noncontact corotron type.

The cleaning blade 8 is made of urethane rubber. The cleaning blade 8 scrapes off and removes the residual toner 6 remaining on the photosensitive drum 1 after the toner image is transferred to the recording sheet 14. That is, the cleaning blade 8 functions as a cleaning device.

The developing devices 102, 103 and 104 have the same configurations as the developing device 101 except kinds (colors) of the toners. In the image forming apparatus shown in FIG. 1, the developing device 101 uses a black toner, the developing device 102 uses a yellow toner, the developing device 103 uses a magenta toner, and the developing device 104 uses a cyan toner.

The fixing device 105 fixes the toner image to the recording sheet 14 fed in the direction indicated by arrow Rh. The heat roller 12 and the pressure roller 10 rotate along the feeding direction of the recording sheet 14 indicated by arrow Rh.

Although the image forming apparatus shown in FIG. 1 uses the fixing device 10 of a roller-type, it is possible to use a fixing device of other type such as a belt-type that uses a belt, a film-type that uses a film or a flash-type that utilizes light energy.

The roller type and belt type fixing device may be of an oil-replenishing type fixing device equipped with an oil replenishing mechanism such as an oil replenishing roller, an oil replenishing sheet or an oil tank. The oil replenishing mechanism is configured to replenish oil to the heat roller, belt or the like to thereby prevent hot-offset phenomena. The oil is not limited to a specific kind, but silicone oil, mineral oil and the like having relatively low viscosity are generally used. Further, it is also possible to prevent hot-offset phenomena using an oil-less type fixing device.

The present invention is intended to enhance cleaning performance in the respective developing devices 101 through 104 even when a spherical toner is used as a developer.

A manufacturing process of the spherical toner 6 used in Examples (described later) of Embodiment 1 will be described herein.

The following materials are put in an attritor (MA-01SC manufactured by Mitsui-Miike Machinery Co., Ltd.): 77.5 weight parts of styrene as binder agent, 22.5 weight parts of n-butyl acrylate, 1.5 weight parts of lower molecular polyethylene as offset preventing agent, 2 weight parts of "Aizen Spilon Black TRH" (manufactured by Hodogaya Chemical Co. Ltd) as charge controlling agent, 7 weight parts of carbon black (PrintexL manufactured by Degussa Corp.) as coloring agent and 1 weight part of 2-2' azobisisobutyronitrile. These materials are dispersed for 10 hours at a temperature of 15° C. in the attritor, so that a polymer composition is obtained. Further, 180 weight parts of ethanol in which 8 weight parts of polyacrylic acid and 0.35 weight parts of divinylbenzene are dissolved is prepared. 600 weight parts of distilled water is added to the ethanol, so that a dispersion medium (for polymerization) is obtained. Then, the above described polymer composition is added to the dispersion medium, and dispersed using TK homo mixer (M-type manufactured by Tokushu Kika Kogyo Co., Ltd.) for 10 minutes at a rotational speed of 8000 rpm, so that a dispersion solution is obtained.

Next, 1 liter of the dispersion solution is put in a separable flask, and is agitated at a rotational speed of 100 rpm in a nitrogen stream for 12 hours at a temperature of 85° C. to cause a reaction. Then, the dispersion solution is cooled, and the dispersion medium is dissolved using 0.5N hydrochloric acid solution. The resultant material is filtered, rinsed, air-dried, dried under reduced pressure at a pressure of 10 mmHg for 10 hours at a temperature of 40° C., and then classified using an air classifier. Thereafter, the resultant material is added with 1.0 weight part of hydrophobic silica fine powder "Aerosil 11R-972" (manufactured by Nippon Aerosil Co., Ltd.), so that a spherical toner having mean particle diameter of 7 μm and circularity greater than or equal to 0.9 is obtained. In this regard, "circularity" is a value determined by $4\pi S/L^2$ where S represents an area of a two-dimensional projected image of a particle and L represents a length of a circumference of the projected image.

Figure 3:
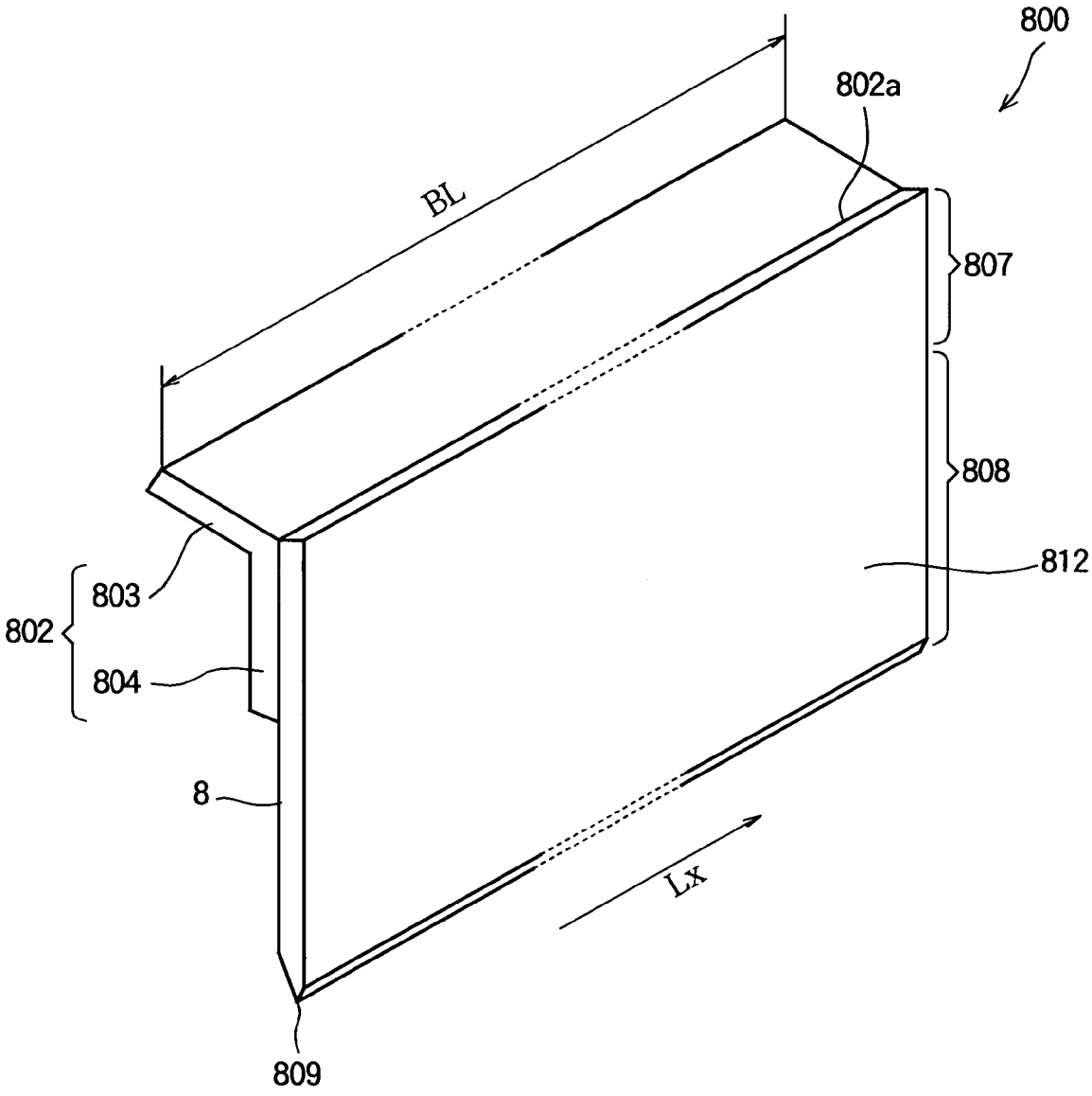
FIG. 3 is a perspective view showing the cleaning device according to Embodiment 1.
Figure 4A:
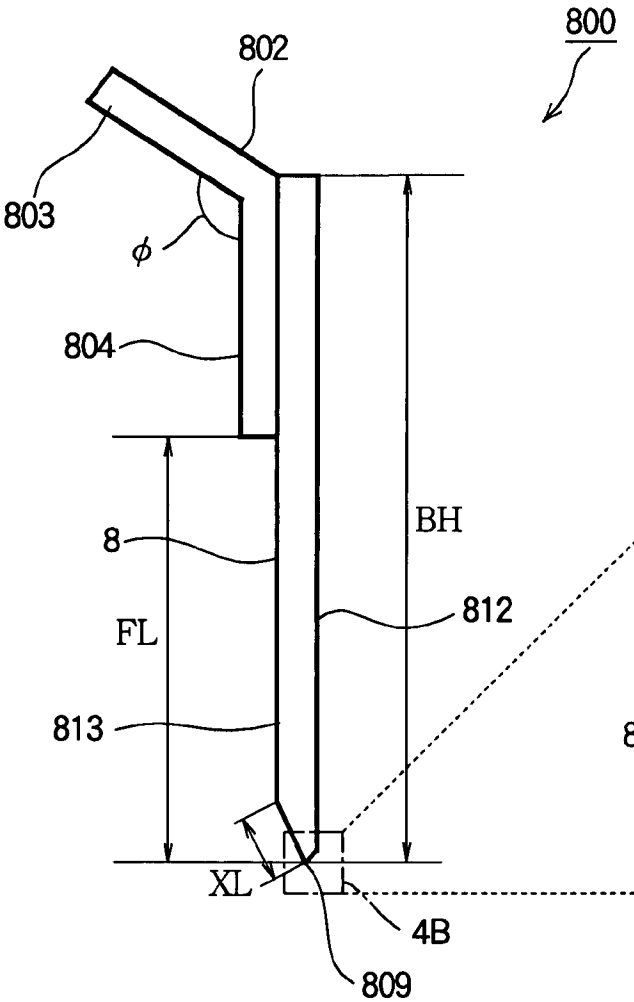
FIG. 4A is a cross-sectional view showing the cleaning device according to Embodiment 1.
Figure 4B:
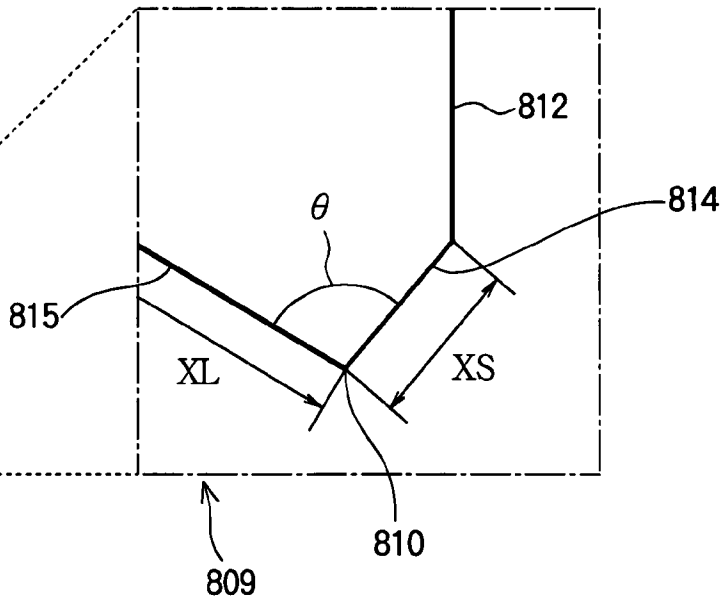
FIG. 4B is an enlarged view showing a part in FIG. 4A.

Next, the cleaning blade 8 of Embodiment 1 will be herein described with reference to FIGS. 3, 4A and 4B. FIG. 3 is a perspective view showing a cleaning device 800. FIG. 4A is a cross-sectional view showing the cleaning device 800. FIG. 4B is an enlarged view of a part indicated by a mark 4B in FIG. 4A.

The cleaning blade 8 is supported by, for example, a supporting body 802 as shown in FIGS. 3 and 4A. The cleaning blade 8 and the supporting body 802 constitute the cleaning device 800.

The supporting body 802 includes a first band-shaped portion 803 and a second band-shaped portion 804 combined to each other so that a predetermined angle ϕ is formed therebetween. The angle ϕ is set to, for example, 150°. The supporting body 802 is formed by, for example, bending a band-shaped plate member along an imaginary line 802*a* extending in a longitudinal direction thereof, i.e., in a direction Lx (FIG. 3) parallel to a rotation axis of the photosensitive drum 1 in a state where the cleaning device 800 is mounted to the developing device (for example, the developing device 101 shown in FIG. 2). The first band-shaped portion 803 is fixed to a frame 806 (FIG. 2) of the developing device.

The cleaning blade 8 is substantially in the form of a band or strip. The longitudinal direction of the cleaning blade 8 is aligned with the longitudinal direction of the supporting body 802. A part (i.e., a stationary part 807) of the cleaning blade 8 is fixed to the second band-shaped portion 804 of the supporting body 802 by means of thermal melt bonding. A remaining part of the cleaning blade 8 (other than the stationary part 807) constitutes a deflectable part 808 which is freely deflectable. A length (i.e., a dimension in the longitudinal direction) of the cleaning blade 8 is expressed as BL as shown in FIG. 3, and a height (i.e., a dimension in widthwise direction) of the cleaning blade 8 is expressed as BH as shown in FIG. 4A. Further, a height of the deflectable part 808 (i.e., a free length) is expressed as FL as shown in FIG. 4A.

An edge portion 809 (i.e., a deflectable part end) of the deflectable part 808 is in the shape of a knife edge. The edge portion 809 is shown in FIG. 4B in an enlarged scale.

As shown in FIG. 4B, the edge portion 809 includes a first inclined surface 814 (i.e., a first surface) adjacent to and inclined with respect to a side surface 812 of the cleaning blade 8 and a second inclined surface 815 (i.e., a second surface) adjacent to and inclined with respect to another side surface 813 (FIG. 4A) of the cleaning blade 8.

In a cross-section cut along a plane perpendicular to the longitudinal direction Lx (FIG. 3) of the cleaning blade 8, a distance between the first and second inclined surfaces 814 and 815 gradually decreases toward a tip 810 of the edge portion 809. In other words, the edge portion 809 has a tapered shape, i.e., a shape such that a width thereof decreases toward the tip 810.

The first inclined surface 814 and the second inclined surface 815 have elongated rectangular shapes. Lengths of longer sides of the first inclined surface 814 and the second inclined surface 815 are the same as the length BL (i.e., a dimension in longitudinal direction) of the cleaning blade 8. Lengths XS and XL of shorter sides of the first inclined surface 814 and the second inclined surface 815 are lengths in the cross section shown in FIG. 4B.

The length XS (i.e., the length in the cross-section shown in FIG. 4B) of the shorter side of the first inclined surface 814 is shorter than the length XL of the shorter side of the second inclined surface 815. Therefore, an area of the first inclined surface 814 is smaller than an area of the second inclined surface 815. An angle θ (i.e., an edge angle) between the first inclined surface 814 and the second inclined surface 815 at the tip 810 of the edge portion 809 is, for example, in a range from 42° to 129°.

Examples

Next, Examples of Embodiment 1 will be described, as well as Comparison Example and Reference Examples.

The cleaning blades 8 of Comparison Example, Examples 1-1, 1-2 and 1-3 and Reference Examples 1-1 and 1-2 are composed of polyurethane rubber blades having a JIS-A hardness of 72 degrees, and are manufactured by die molding. Dimensions of the respective cleaning blades 8 are shown in TABLE 1.

In the TABLE 1, "d" represents a thickness (mm) of the cleaning blade 8. "P" represents a contact pressure between the cleaning blade 8 and the photosensitive drum 1. Further, as described above, "XL" represents the length of the shorter side of the second inclined surface 815. "XS" represents the length of the shorter side of the first inclined surface 814. "BL" represents the length of the cleaning blade 8 in the longitudinal direction. "θ" represents the edge angle between the first and second inclined surfaces 814 and 815. "FL" represents the height of the deflectable part 808.

TABLE 1

| | d (mm) | BH (mm) | XL (μm) | XS (μm) | BL (mm) | θ (°) | FL (mm) | P (gf/cm$^2$) |
|---|---|---|---|---|---|---|---|---|
| Comparison Example | 1.6 | 12.0 | — | — | 238 | — | 7 | 9.5 |
| Reference Example 1-1 | 1.6 | 12.0 | 5802 | 19 | 238 | 29 | 7 | 1.9 |
| Example 1-1 | 1.6 | 12.0 | 2948 | 27 | 238 | 42 | 7 | 6.5 |
| Example 1-2 | 1.6 | 12.0 | 1697 | 10 | 238 | 97 | 7 | 19.3 |
| Example 1-3 | 1.6 | 12.0 | 1685 | 18 | 238 | 129 | 7 | 8.7 |
| Reference Example 1-2 | 1.6 | 12.0 | 1681 | 20 | 238 | 151 | 7 | 22.8 |

The cleaning blade 8 has the height BH of 12.0 mm, the length BL of 238 mm and the thickness d of 1.6 mm, and is bonded to the supporting body 802 having the angle ϕ of 150° by means of thermal melt bonding so that the first inclined surface 814 faces the photosensitive drum 1. The free length FL (i.e., the height of the deflectable part 808) is 7 mm.

Figure 5A:
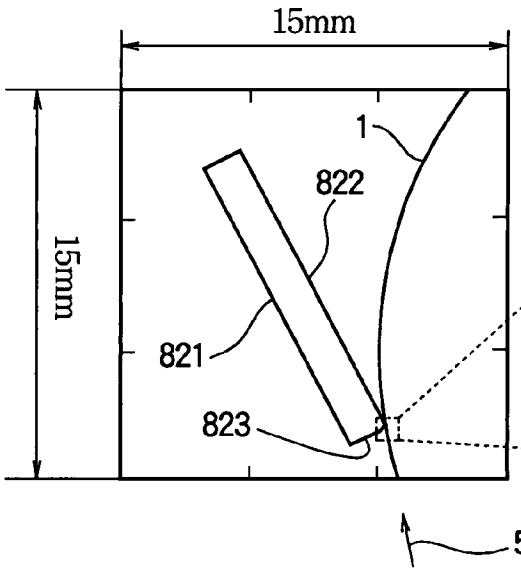
FIG. 5A is a schematic view showing a positional relationship between a cleaning blade of Comparison Example and a photosensitive drum based on structural analysis.

FIG. 5A shows a cleaning blade 821 of Comparison Example that has no tapered edge portion 809 but has a constant thickness is prepared. Except the edge portion, the cleaning blade 821 of Comparison Example has substantially the same structure as the cleaning blade 8 shown in FIGS. 3 and 4A.

The detail of the edge portion 809 of the cleaning blade 8 and structural analysis results thereof will be described with reference to FIGS. 5A through 10B.

FIGS. 5A, 6A, 7A, 8A, 9A and 10A are schematic views showing positional relationships between the cleaning blades and the photosensitive drums in Comparison Example, Reference Example 1-1, Examples 1-1, 1-2 and 1-3 and Reference Example 1-2 based on structural analysis. FIGS. 5B, 6B, 7B, 8B, 9B and 10B are enlarged views showing portions where the tips of the cleaning blades contact the photosensitive drums in FIGS. 5A, 6A, 7A, 8A, 9A and 10A. The indications "15 mm" and "200 μm" in FIGS. 5A through 10B respectively indicate reduction scales. FIG. 5C is a schematic view showing a portion where the cleaning blade 821 of Comparison Example contacts the photosensitive drum 1 as seen in a direction indicated by arrow 5C in FIG. 5A (i.e., a tangential direction of the photosensitive drum 1) which is perpendicular to the longitudinal direction of the cleaning blade 821.

The cleaning blades 8 (821) of Comparison Example, Examples 1-1, 1-2, 1-3 and Reference Examples 1-1 and 1-2 are mounted in the developing device shown in FIG. 2 so that the contact pressures (P) as shown in TABLE 1 are obtained.

Figure 11:
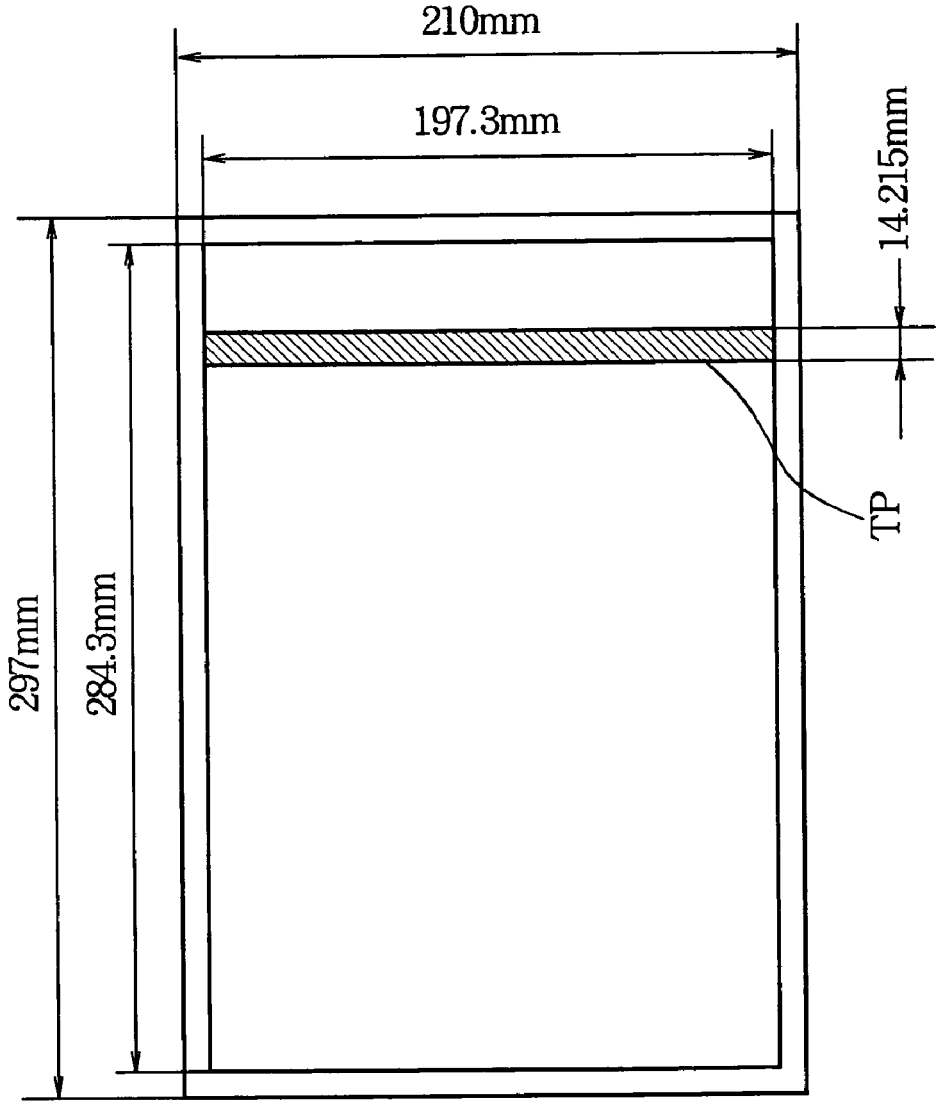
FIG. 11 shows a test pattern used in a printing test for evaluating cleaning performance.

FIG. 11 shows a test pattern used in a printing test for evaluating cleaning performance. As shown in FIG. 11, the test pattern TP is band-shaped and has a length of 14.215 mm and a width of 197.3 mm (in the case where the test pattern TP is printed on the recording sheet 14 of A4 size). That is, the test pattern TP occupies 5% of an entire printable area on the recording sheet 14. The test patterns TP are printed on 30000 recording sheets 14 which corresponds to a lifetime of the developing device.

Once the toner passes through the cleaning blade 8, the subsequent toner also passes through the cleaning blade 8 at the same position in the longitudinal direction of the cleaning blade 8. The toner having passed the cleaning blade 8 adhere to the charging roller 2 to form a streak on the surface of the charging roller 2. In a region where the toner adheres to the charging roller 2, the amount of electric charge is reduced. Therefore, in a region on the surface of the photosensitive drum 1 facing the streak on the charging roller 2, electric charge is insufficient, and therefore the amount of toner adhering to the photosensitive drum 1 is reduced. As a result, a white streak appears in the test pattern printed on the recording sheet 14. The white streak is undistinguishable unless the amount of the toner adhering to the charging roller 2 reaches a predetermined amount.

Figure 12:
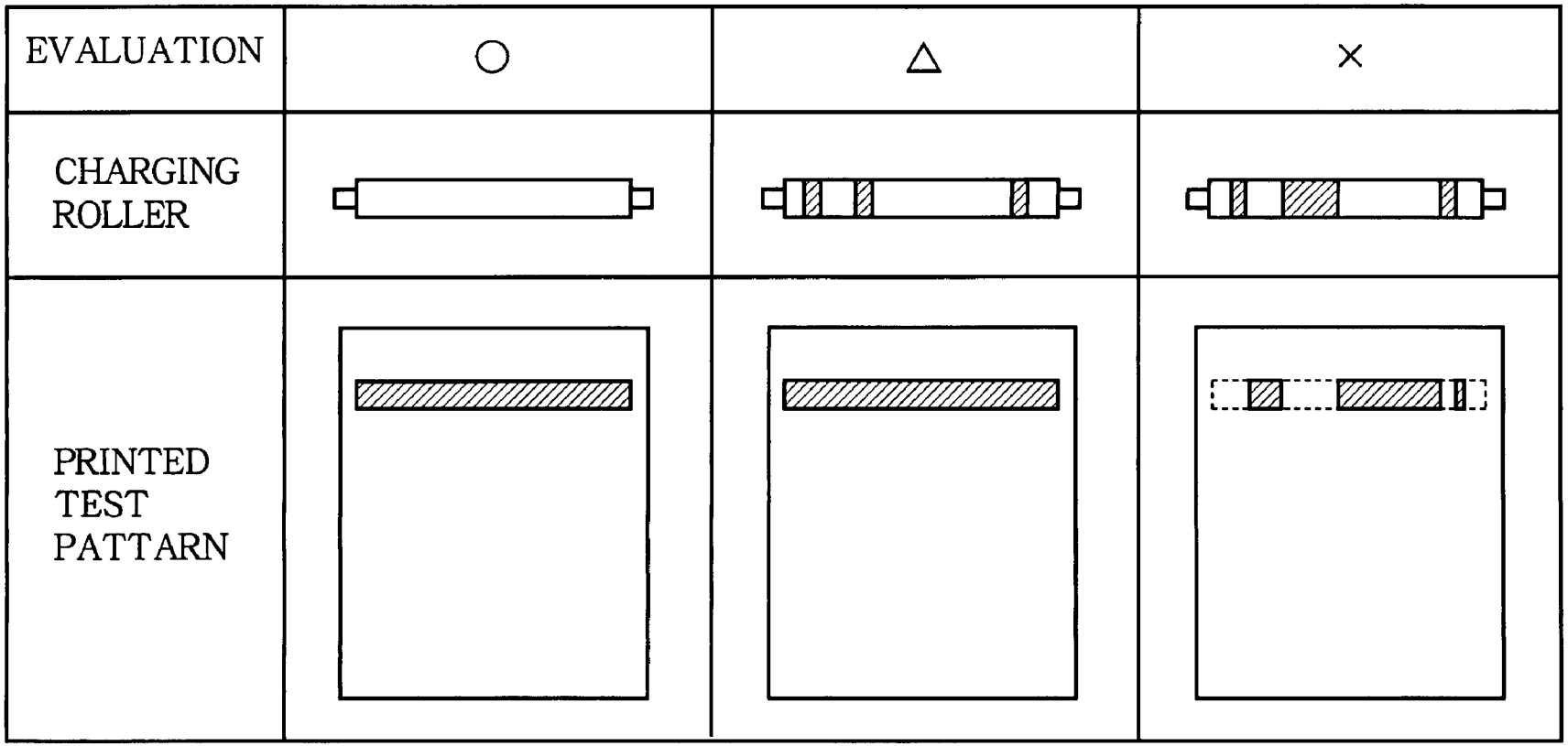
FIG. 12 shows an evaluation method in the cleaning performance test.

For this reason, cleaning performance is evaluated using a scale of 1 to 3 based on the amount of the toner adhering to the charging roller 2 and the presence/absence of white streak in the printed test pattern (FIG. 11). To be more specific, when no toner adheres to the charging roller 2 and no white streak is observed in the printed test pattern, the cleaning performance is evaluated as excellent (indicated by mark "O" in FIG. 12 and TABLE 2). When the toner adheres to the charging roller 2 but no white streak is observed in the printed test pattern, the cleaning performance is evaluated as semi-poor (indicated by mark "Δ" in FIG. 12 and TABLE 2). When toner adheres to the charging roller 2 and the white streak is observed in the printed test pattern, the cleaning performance is evaluated as poor (indicated by mark "X" in FIG. 12 and TABLE 2). The same evaluation criteria are applied to all Examples, Comparison Example and Reference Examples.

TABLE 2

| | Edge Angle θ (°) | Evaluation Result |
|---|---|---|
| Comparison Example | — | X |
| Reference Example 1-1 | 29 | X |
| Example 1-1 | 42 | ○ |
| Example 1-2 | 97 | ○ |
| Example 1-3 | 129 | ○ |
| Reference Example 1-2 | 151 | Δ |

Figure 13:
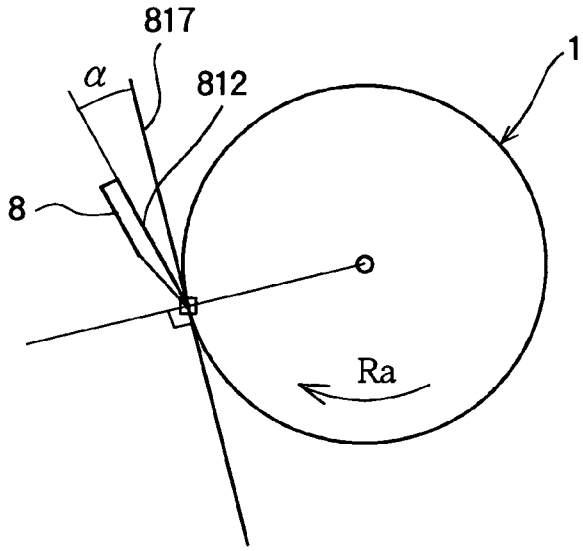
FIG. 13 is a schematic view for illustrating an angle between a side surface of the cleaning blade and the photosensitive drum.

In this regard, as shown in FIG. 13, "α" represents an angle between the side surface 812 of the cleaning blade 8 (i.e., a surface of the cleaning blade 8 on a side contacting the photosensitive drum 1) and the surface of the photosensitive drum 1. To be more specific, "α" represents an angle between the side surface 812 (on the side contacting the photosensitive drum 1) of the cleaning blade 8 and a tangential plane 817 of the photosensitive drum 1 where the photosensitive drum 1 contacts the cleaning blade 8. In this embodiment, the angle α is, for example, 18.34°. In this regard, the angle α may vary at the tip of the cleaning blade 8 because of deformation of the cleaning blade 8 (see FIG. 6B described later). In FIG. 13, the rotational direction of the photosensitive drum 1 is indicated by arrow Ra.

Figure 5B:
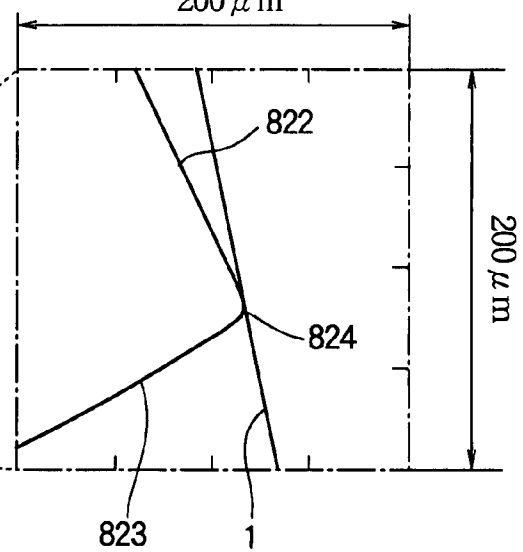
FIG. 5B is an enlarged schematic view showing a part of FIG. 5A.
Figure 5C:
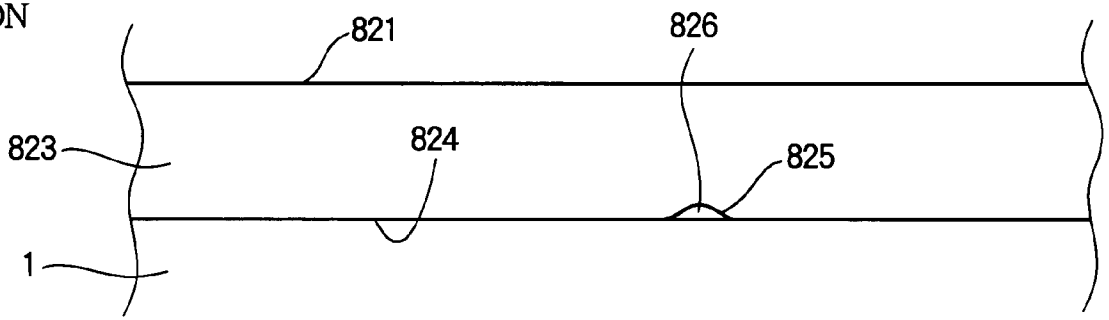
FIG. 5C is a schematic view showing the cleaning blade as seen in a direction indicated by arrow 5C in FIG. 5A.

As shown in FIGS. 5A, 5B and 5C, the cleaning blade 821 of Comparison Example has a side surface 822 and an end surface 823 perpendicular to the side surface 822. A corner portion 824 between the side surface 822 and the end surface 823 contacts the photosensitive drum 1. As the photosensitive drum 1 rotates, the corner portion 824 is dragged in the rotational direction of the photosensitive drum 1. As a result, the edge portion of the cleaning blade 821 partially deflects as indicated by a numeral 825 in FIG. 5C, and a recess 826 is formed between the deflected portion 825 and the photosensitive drum 1. The recess 826 is so shaped that a width thereof sharply decreases in a rotational direction of the photosensitive drum 1. The recess 826 is relatively wide compared with the size of the toner, and therefore the toner is more likely to move into the recess 826 but is less likely to move out of the recess 826. That is, the toner is more likely to be accumulated in the recess 826. Such accumulated toner in the recess 826 is urged by subsequent toner, and is pushed into between the cleaning blade 821 and the photosensitive drum 1. Further, a dimension of an area where the cleaning blade 821 contacts the photosensitive drum 1 is relatively small in the circumferential direction of the photosensitive drum 1, and therefore a force for pushing the toner out of the recess 826 (in a direction opposite to the rotational direction of the photosensitive drum 1) is relatively small. As a result, the cleaning blade 821 of Comparison Example allows passage of the toner, which results in poor cleaning performance.

Figure 6A:
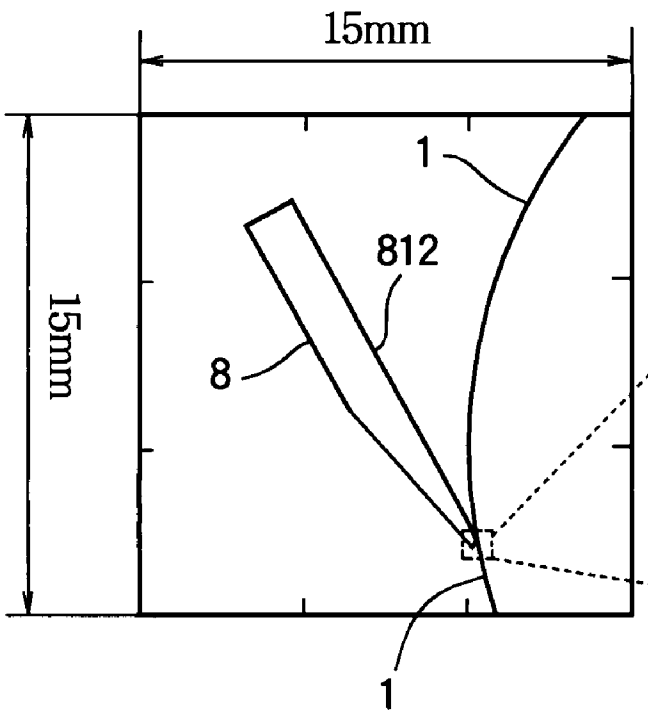
FIG. 6A is a schematic view showing a positional relationship between a cleaning blade of Reference Example 1-1 and the photosensitive drum based on structural analysis.
Figure 6B:
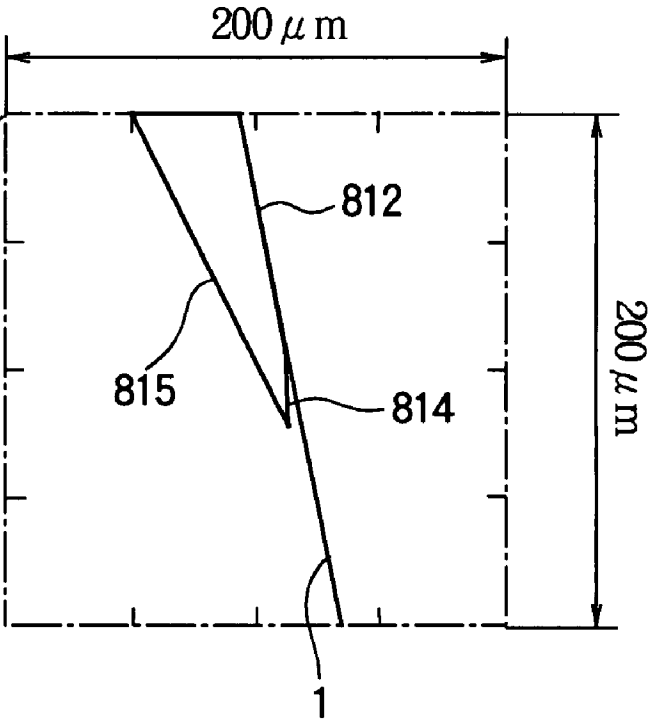
FIG. 6B is an enlarged schematic view showing a part in FIG. 6A.

As shown in FIG. 6B, the cleaning blade 8 of Reference Example 1-1 has the first inclined surface 814 and the second inclined surface 815, but the edge angle θ therebetween is 29° (see TABLE 1). In this case, due to the deflection of the edge portion of the cleaning blade 8, the first inclined surface 814 (which is to contact the photosensitive drum 1) of the cleaning blade 8 is shifted away from the photosensitive drum 1 and does not contact the photosensitive drum 1. Instead, the side surface 812 (which is not to contact the photosensitive drum 1) of the cleaning blade 8 contacts the photosensitive drum 1. Therefore, the contact pressure (P) between the cleaning blade 8 and the photosensitive drum 1 becomes small (1.9 gf/cm$^2$). As a result, the cleaning blade 8 of Reference Example 1-1 exhibit poor cleaning performance.

Figure 7A:
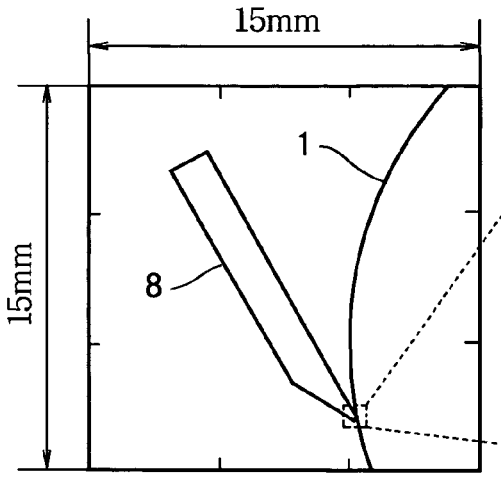
FIG. 7A is a schematic view showing a positional relationship between a cleaning blade of Example 1-1 and a photosensitive drum based on structural analysis.
Figure 7B:
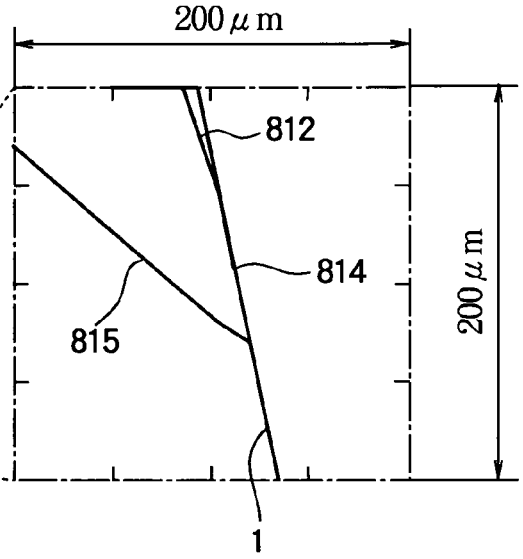
FIG. 7B is an enlarged schematic view showing a part in FIG. 7A.

As shown in FIG. 7B, in Example 1-1, the first inclined surface 814 having a relatively small area substantially entirely contacts the photosensitive drum 1, and no recess (see FIG. 5C) is formed between the cleaning blade 8 and the photosensitive drum 1. Therefore, accumulation of the toner does not occur. Even when the toner (in the vicinity of the tip of the cleaning blade 8) is urged by the subsequent toner, the toner does not move into between the cleaning blade 8 and the photosensitive drum 1, but is guided outwardly along the second inclined surface 815. That is, the cleaning blade 8 prevents the toner from moving into between the cleaning blade 8 and the photosensitive drum 1. For this reason, the cleaning blade 8 of Example 1-1 has a configuration that guides the toner outwardly and prevents accumulation of the toner, and therefore exhibits excellent cleaning performance.

Figure 8A:
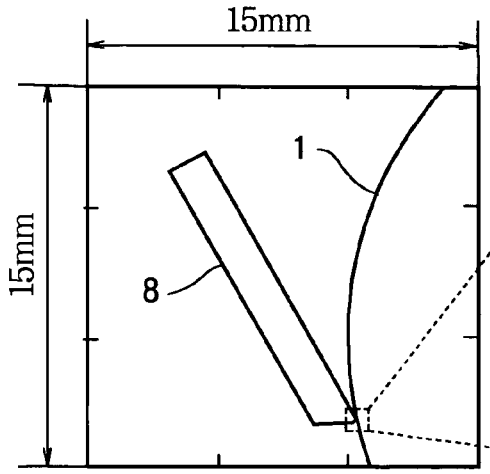
FIG. 8A is a schematic view showing a positional relationship between a cleaning blade of Example 1-2 and the photosensitive drum based on structural analysis.
Figure 8B:
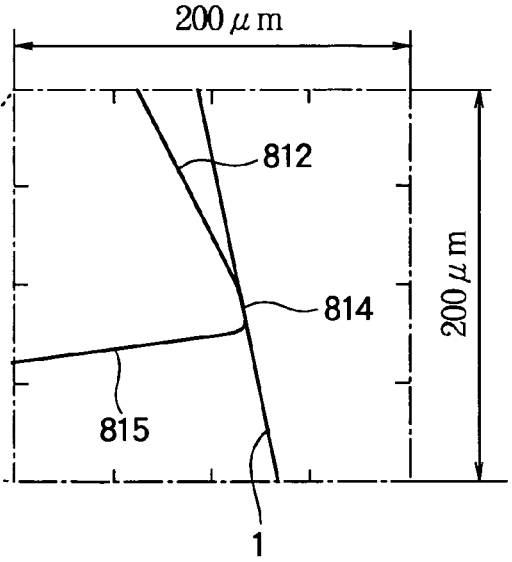
FIG. 8B is an enlarged schematic view showing a part in FIG. 8A.

As shown in FIG. 8B, in Example 1-2, the first inclined surface 812 having a relatively small area substantially entirely contacts the photosensitive drum 1, and a recess formed between the cleaning blade 8 and the photosensitive drum 1 is very small compared with the particle diameter of the toner. Therefore, accumulation of the toner in the recess is restricted. That is, even when the toner (in the vicinity of the tip of the cleaning blade 8) is urged by the subsequent toner, the toner does not move into between the cleaning blade 8 and the photosensitive drum 1, but is guided outwardly along the second inclined surface 815. In other words, the cleaning blade 8 prevents the toner from moving into between the cleaning blade 8 and the photosensitive drum 1. Further, a dimension of an area where the cleaning blade 8 contacts the photosensitive drum 1 is very small, and therefore a pressure with which the cleaning blade 8 contacts the photosensitive drum 1 is large (19.3 gf/cm$^2$). Therefore, a large force for pushing the toner out of the recess is obtained. As a result, the cleaning blade 8 of Example 1-2 has a configuration that guides the toner outwardly and prevents accumulation of the toner, and therefore exhibits excellent cleaning performance.

Figure 9A:
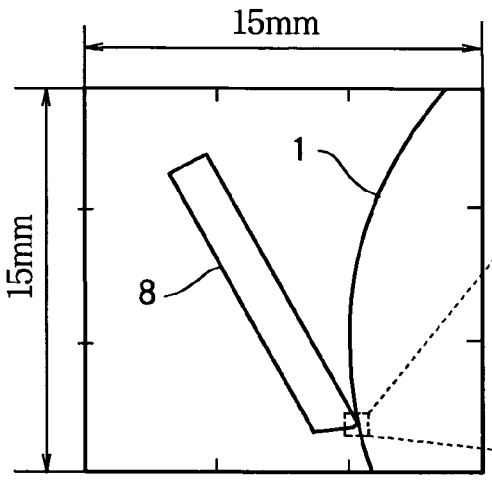
FIG. 9A is a schematic view showing a positional relationship between a cleaning blade of Example 1-3 and the photosensitive drum based on structural analysis.
Figure 9B:
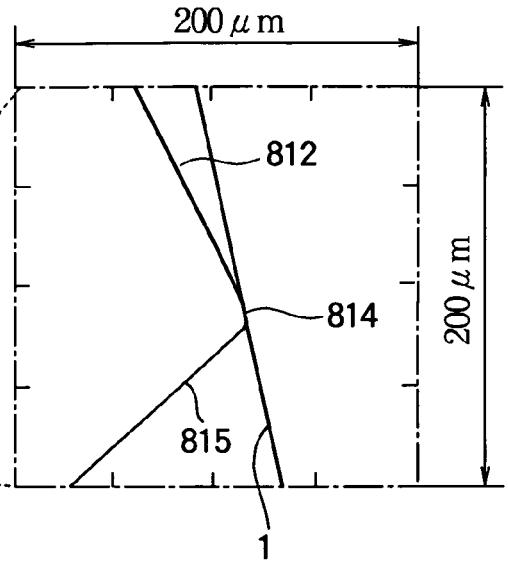
FIG. 9B is an enlarged schematic view showing a part in FIG. 9A.

As shown in FIG. 9B, in Example 1-3, the first inclined surface 814 having a relatively small area substantially entirely contacts the photosensitive drum 1, and a recess formed between the cleaning blade 8 and the photosensitive drum 1 is small compared with the particle diameter of the toner. Therefore, accumulation of the toner in the recess is restricted. That is, even when the toner (in the vicinity of the tip of the cleaning blade 8) is urged by the subsequent toner, the toner does not move into between the cleaning blade 8 and the photosensitive drum 1, but is guided outwardly along the second inclined surface 815. As a result, the cleaning blade 8 prevents the toner from moving into between the cleaning blade 8 and the photosensitive drum 1, and therefore exhibits excellent cleaning performance.

Figure 10A:
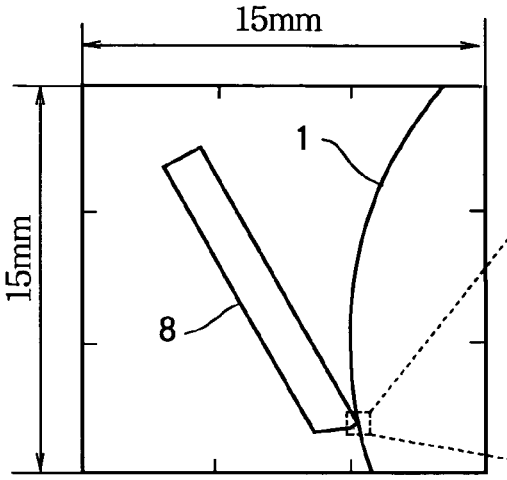
FIG. 10A is a schematic view showing a positional relationship between a cleaning blade of Reference Example 1-2 and the photosensitive drum based on structural analysis.
Figure 10B:
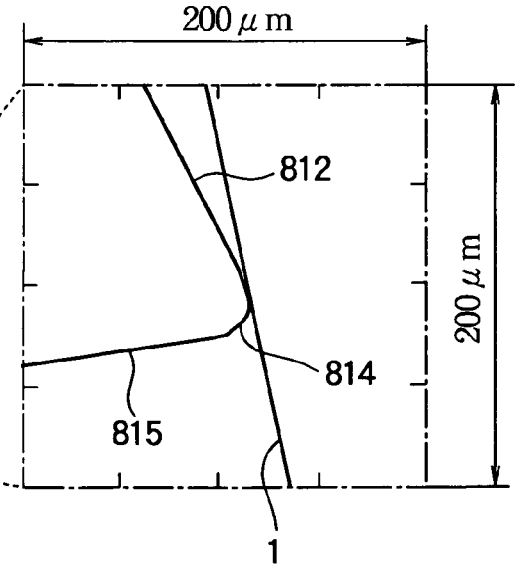
FIG. 10B is an enlarged schematic view showing a part in FIG. 10A.

As shown in FIG. 10B, in Reference Example 1-2, the edge angle θ between the first and second inclined surfaces 814 and 815 is 151°. In this case, the surface 814 (having a relatively small area) does not contact the photosensitive drum 1. Therefore, substantially in the same way as Comparison Example, the cleaning blade 8 of Reference Example 1-2 allows passage of the toner, and therefore exhibits semi-poor cleaning performance.

As described above, the cleaning device of Embodiment 1 includes the cleaning blade 8 provided so as to contact the image bearing body (i.e., the photosensitive drum 1 that bears a developer image) for scraping the developer adhering to the image bearing body. The cleaning blade 8 has at least two surfaces (i.e., the inclined surfaces 814 and 815) disposed on the edge portion 809 and having different lengths in a direction perpendicular to the longitudinal direction of the cleaning blade 8 (i.e., having different areas), and the smaller surface (i.e., the first inclined surface 814) contacts the image bearing body. The edge angle θ between these two surfaces is preferably in a range from 42° to 129°. Using such a cleaning device, excellent cleaning performance can be obtained.

Embodiment 2

Figure 14A:
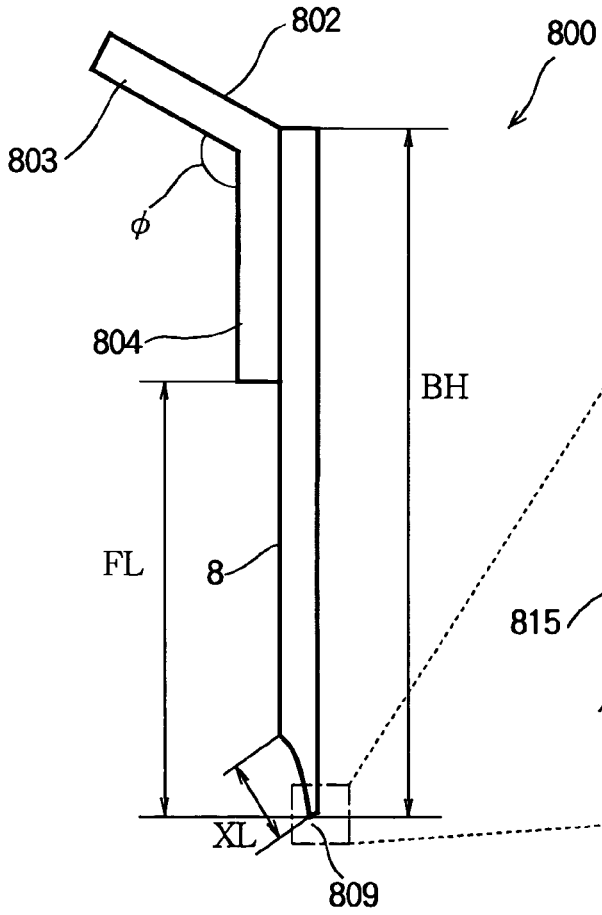
FIG. 14A is a cross-sectional view showing a cleaning device according to Embodiment 2.
Figure 14B:
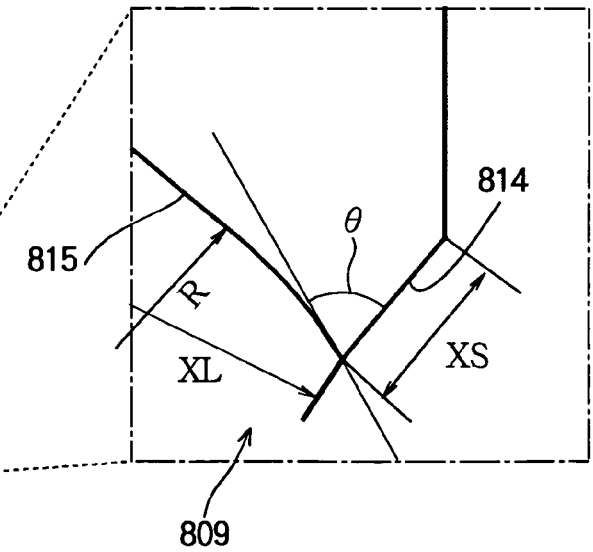
FIG. 14B is an enlarged view showing a part in FIG. 14A.

FIG. 14A is a cross-sectional view showing a cleaning device according to Embodiment 2 of the present invention. FIG. 14B is an enlarged view showing an edge portion of a cleaning blade of the cleaning device shown in FIG. 14A. The cleaning device of Embodiment 2 is different from the cleaning device of Embodiment 1 in that the second inclined surface 815 of the cleaning blade 8 of Embodiment 2 is concavely curved in a cross section perpendicular to a longitudinal direction of the cleaning blade 8. The curved surface (the second inclined surface 815) is a substantially cylindrical surface (more specifically, a surface of a cylinder whose center axis is parallel to the longitudinal direction of the cleaning blade 8), and has a radius of curvature R of, for example, 0.2 mm.

Example

The cleaning blade 8 of Example 2 of Embodiment 2 is formed of polyurethane rubber having a JIS-A hardness of 72 degrees, and is manufactured by die molding, as was described in relation to Examples 1-1 through 1-3. Dimensions of the cleaning blade 8 of Example 2 are shown in TABLE 3. As was described in relation to Examples 1-1 through 1-3, the cleaning blade 8 has a thickness (d) of 1.6 mm, and is fixed to the supporting body 802 by means of thermal melt bonding in such a manner that the first inclined surface 814 faces and contacts the photosensitive drum 1. The supporting body 802 includes the first and second band-shaped portions 803 and 804 combined to each other so that the angle ϕ therebetween is 150° as was described in relation to Examples 1-1 through 1-3. The free length FL is 7 mm. The edge angle θ between the first and second inclined surfaces 814 and 815 at the tip of the edge portion 809 is 97°. TABLE 3 also shows Comparison Example which is the same as that shown in TABLE 1.

In TABLE 3, "d" represents the thickness of the cleaning blade 8. "BH" represents the height of the cleaning blade 8. "XL" represents the length of the shorter side of the second inclined surface 815. "XS" represents the length of the shorter side of the first inclined surface 814. "BL" represents the length of the cleaning blade 8 in the longitudinal direction. "R" represents the radius of curvature of the second inclined surface 815. "FL" represents the height of the deflectable part 808. "P" represents the contact pressure with which the cleaning blade 8 contacts the photosensitive drum 1.

TABLE 3

| | d (mm) | BH (mm) | XL (μm) | XS (μm) | BL (mm) | R (mm) | FL (mm) | P (gf/cm$^2$) |
|---|---|---|---|---|---|---|---|---|
| Comparison Example | 1.6 | 12.0 | — | — | 238 | — | 7 | 9.5 |
| Example 2 | 1.6 | 12.0 | 1697.4 | 9.5 | 238 | 0.2 | 7 | 20.1 |

Figure 15A:
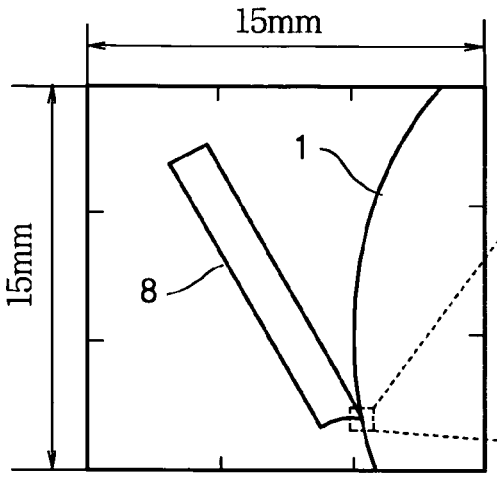
FIG. 15A is a schematic view showing a positional relationship between a cleaning blade of Example 2 and the photosensitive drum based on structural analysis.
Figure 15B:
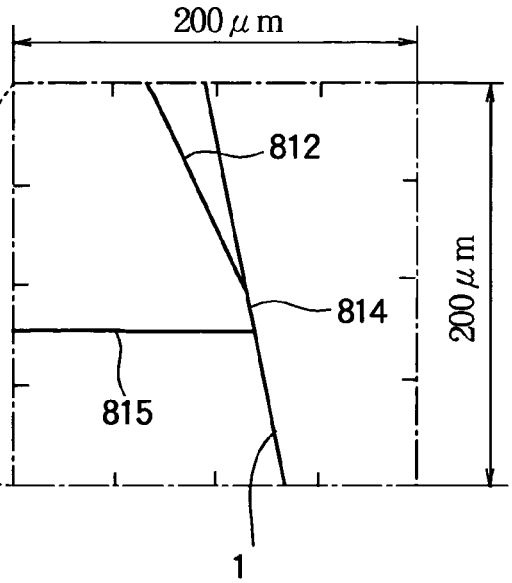
FIG. 15B is an enlarged schematic view showing a part in FIG. 15A.

The second inclined surface 815 (that does not contact the photosensitive drum 1) of the cleaning blade 8 is concavely curved, and therefore prevents the edge portion 809 of the cleaning blade 8 from deflecting (according to the rotation of the photosensitive drum 1) and forming a wedge portion between the cleaning blade 8 and the photosensitive drum 1 in which the toner is accumulated. In other words, due to the curvature of the second inclined surface 815, accumulation of toner at the tip of the cleaning blade 8 is prevented. FIG. 15A schematically shows positional relationship between the cleaning blade 8 and the photosensitive drum 1 in Example 2 based on structural analysis. FIG. 15B shows a contact portion between the tip of the cleaning blade 8 and the photosensitive drum 1 in an enlarged scale.

The cleaning blade 8 manufactured as described above is mounted in the developing device shown in FIG. 2 in such a manner that the contact pressure (P) as shown in TABLE 3 is obtained, and printing test is performed. Conditions of the printing test are the same as those described in relation to Examples 1-1 to 1-3.

TABLE 4

| | EVALUATION RESULT |
|---|---|
| Comparison Example | X |
| Example 2 | ○ |

The printing test is performed on 30000 recording sheets 14 under the same conditions as those described in relation to Examples 1-1 to 1-3. As a result, when the cleaning blade 8 having the second inclined surface 815 which is concavely curved is used (Example 2), excellent cleaning performance is obtained.

As described above, the cleaning device according to Embodiment 2 includes a cleaning blade 8 provided so as to contact the image bearing body (i.e., the photosensitive drum 1 that bears a developer image) for scraping the developer adhering to the image bearing body. The cleaning blade 8 has at least two surfaces (i.e., the inclined surfaces 814 and 815) disposed on the edge portion 809 and having different lengths in a direction perpendicular to the longitudinal direction of the cleaning blade 8 (i.e., having different areas), and the smaller surface (i.e., the first inclined surface 814) contacts the image bearing body. In addition, the surface (i.e., the second inclined surface 815) opposite to the surface (i.e., the first inclined surface 814) contacting the image bearing body is concavely curved. Using such a cleaning device, excellent cleaning performance can be obtained.

Embodiment 3

FIG. 16A is a cross-sectional view showing a cleaning device according to Embodiment 3 of the present invention. FIG. 16B is an enlarged view showing an edge portion of a cleaning blade of the cleaning device shown in FIG. 16A. FIG. 17A is a cross-sectional view showing another configuration of the cleaning device according to Embodiment 3 of the present invention. FIG. 17B is an enlarged view showing an edge portion of a cleaning blade of the cleaning device shown in FIG. 17A. The cleaning device of Embodiment 3 is different from the cleaning devices of Embodiments 1 and 2 in that the first inclined surface 814 (contacting the photosensitive drum 1) of the cleaning blade 8 is concavely curved. The curved surface (the first inclined surface 814) is a substantially cylindrical surface (more specifically, a surface of a cylinder whose center axis is parallel to the longitudinal direction of the cleaning blade 8), and has a radius of curvature R2, for example, as shown in TABLE 5.

In a configuration shown in FIGS. 16A and 16B (Example 3-1 described later), the second inclined surface 815 is flat as in Embodiment 1. In another configuration shown in FIGS. 17A and 17B (Example 3-2 described later), the second inclined surface 815 is concavely curved as in Embodiment 2.

Examples

The cleaning blades 8 of Examples 3-1 and 3-2 are formed of polyurethane rubber having a JIS-A hardness of 72 degrees, and are manufactured by die molding, as was described in relation to Examples 1-1 to 1-3. Dimensions of the cleaning blades 8 of Examples 3-1 and 3-2 are shown in TABLE 5. As was described in relation to Examples 1-1 to 1-3, the cleaning blade 8 has a thickness (d) of 1.6 mm, and is fixed to the supporting body 802 by means of thermal melt bonding in such a manner that the first inclined surface 814 faces and contacts the photosensitive drum 1. The supporting body 802 includes the first and second band-shaped portions 803 and 804 combined to each other so that the angle $\phi$ therebetween is 150°, as was described in relation to Examples 1-1 to 1-3. The free length FL is 7 mm. The edge angle $\theta$ between the first and second inclined surfaces 814 and 815 at the tip of the edge portion is 97° TABLE 5 also shows Comparison Example which is the same as that shown in TABLE 1.

In TABLE 5, "d" represents the thickness of the cleaning blade 8. "BH" represents the height of the cleaning blade 8. "XL" represents the length of the shorter side of the second inclined surface 815. "XS" represents the length of the shorter side of the first inclined surface 814. "BL" represents the length of the cleaning blade 8 in the longitudinal direction. "R1" represents the radius of curvature of the second inclined surface 815. "R2" represents the radius of curvature of the first inclined surface 814. "FL" represents the height of the deflectable part 808. "P" represents the contact pressure with which the cleaning blade 8 contacts the photosensitive drum 1.

TABLE 5

| | d (mm) | BH (mm) | XL (μm) | XS (μm) | BL (mm) | R1 (mm) | R2 (mm) | FL (mm) | P (gf/cm$^2$) |
|---|---|---|---|---|---|---|---|---|---|
| Comparison Example | 1.6 | 12.0 | — | — | 238 | — | — | 7 | 9.5 |
| Example 3-1 | 1.6 | 12.0 | 1697.4 | 9.5 | 238 | 0.2 | — | 7 | 37.4 |
| Example 3-2 | 1.6 | 12.0 | 1697.4 | 9.5 | 238 | 0.2 | 203 | 7 | 19.3 |

Figure 18A:
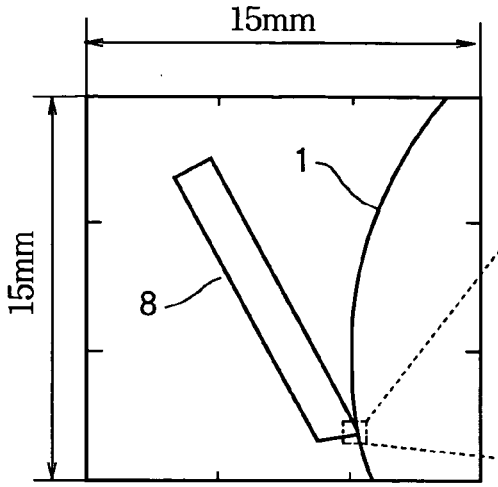
FIG. 18A is a schematic view showing a positional relationship between the cleaning blade of Example 3-1 and the photosensitive drum based on structural analysis.
Figure 18B:
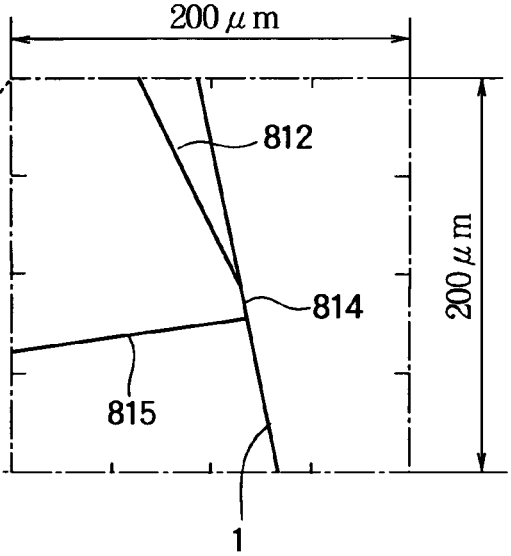
FIG. 18B is an enlarged schematic view showing a part in FIG. 18A.
Figure 19A:
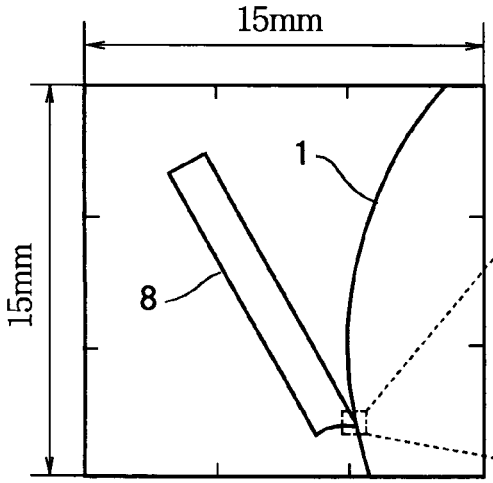
FIG. 19A is a schematic view showing a positional relationship between the cleaning blade of Example 3-2 and the photosensitive drum based on structural analysis.
Figure 19B:
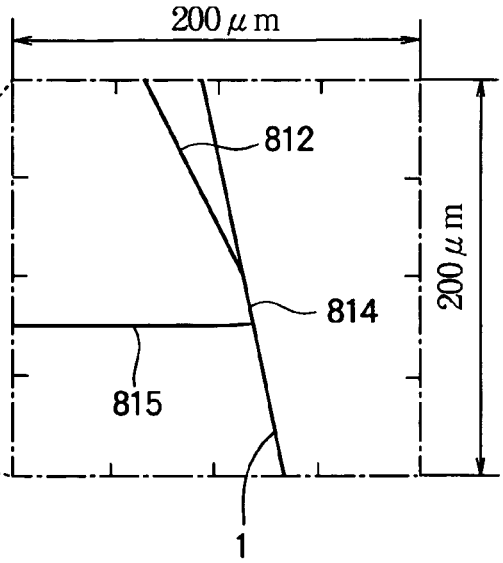
FIG. 19B is an enlarged schematic view showing a part in FIG. 19A.

The first inclined surface 814 of the cleaning blade 8 is concavely curved in order to remove influence of deformation of the cleaning blade 8 along the surface of the photosensitive drum 1. FIG. 18A schematically shows positional relationship between the cleaning blade 8 of Example 3-1 (FIGS. 16A and 16B) and the photosensitive drum 1 based on structural analysis. FIG. 18B shows a contact portion between the tip of the cleaning blade 8 (shown in FIG. 18A) and the photosensitive drum 1 in an enlarged scale. FIG. 19A schematically shows positional relationship between the cleaning blade 8 of Example 3-2 (FIGS. 17A and 17B) and the photosensitive drum 1 based on structural analysis. FIG. 19B shows a contact portion between the tip of the cleaning blade 8 (shown in FIG. 19A) and the photosensitive drum 1 in an enlarged scale.

The cleaning blade 8 manufactured as described above is mounted in the developing device shown in FIG. 2, and printing test is performed. Conditions of the printing test are the same as those described in relation to Examples 1-1 to 1-3. The evaluation result is shown in TABLE 6.

TABLE 6

| | CURVATURE | EVALUATION RESULT |
|---|---|---|
| Comparison Example | — | X |
| Example 3-1 | FIRST INCLINED SURFACE ONLY | ○ |
| Example 3-2 | FIRST AND SECOND INCLINED SURFACES | ○ |

The printing test is performed on 30000 recording sheets 14 under the same conditions as those described in relation to Examples 1-1 to 1-3. As a result, the cleaning blades 8 of Examples 3-1 and 3-2 (each of which has the first inclined surface 814 concavely curved) exhibit excellent cleaning performance.

As described above, the cleaning device according to Embodiment 3 includes a cleaning blade 8 provided so as to contact the image bearing body (i.e., the photosensitive drum 1 that bears a developer image) for scraping the developer adhering to the image bearing body. The cleaning blade 8 has at least two surfaces (i.e., the inclined surfaces 814 and 815) disposed on the edge portion 809 and having different lengths in a direction perpendicular to the longitudinal direction of the cleaning blade 8 (i.e., having different areas), and the smaller surface (i.e., the first inclined surface 814) contacts the image bearing body. In addition, the surface (i.e., the first inclined surface 814) contacting the image bearing body is concavely curved. Using such a cleaning device, excellent cleaning performance can be obtained.

Embodiment 4

FIG. 20A is a cross-sectional view showing a cleaning device according to Embodiment 4 of the present invention. FIG. 21B is an enlarged view showing an edge portion of a cleaning blade of the cleaning device shown in FIG. 20A. FIG. 21A is a cross-sectional view showing another configuration of the cleaning device according to Embodiment 4 of the present invention. FIG. 21B is an enlarged view showing an edge portion a cleaning blade of the cleaning device shown in FIG. 21A. The cleaning device of Embodiment 4 is different from the cleaning devices of Embodiments 1, 2 and 3 in that the first inclined surface 814 (contacting the photosensitive drum 1) of the cleaning blade 8 is convexly curved. The curved surface (the first inclined surface 814) is a substantially cylindrical surface (more specifically, a surface of a cylinder whose center axis is parallel to the longitudinal direction of the cleaning blade 8), and has a radius of curvature R2 as shown in TABLE 7.

In a configuration shown in FIGS. 20A and 20B (Example 4-1 described later), the second inclined surface 815 is flat as in Embodiment 1. In another configuration shown in FIGS. 21A and 21B (Example 4-2 described later), the second inclined surface 815 is concavely curved as in Embodiment 2.

Examples

The cleaning blades 8 of Examples 4-1 and 4-2 are formed of polyurethane rubber having a JIS-A hardness of 72 degrees, and are manufactured by die molding, as was described in relation to Examples 1-1 to 1-3. Dimensions of the cleaning blades 8 of Examples 4-1 and 4-2 are shown in TABLE 7. As was described in relation to Examples 1-1 to 1-3, the cleaning blade 8 has a thickness (d) of 1.6 mm, and is fixed to the supporting body 802 by means of thermal melt bonding in such a manner that the first inclined surface 814 faces and contacts the photosensitive drum 1. The supporting body 802 includes the first and second band-shaped portions 803 and 804 combined to each other so that the angle $\phi$ therebetween is 150°, as was described in relation to Examples 1-1 to 1-3. The free length FL is 7 mm. The edge angle $\theta$ between the first and second inclined surfaces 814 and 815 at the tip of the edge portion is 97°. TABLE 7 also shows Comparison Example which is the same as that shown in TABLE 1.

In TABLE 7, "d" represents the thickness of the cleaning blade 8. "BH" represents the height of the cleaning blade 8. "XL" represents the length of the shorter side of the second inclined surface 815. "XS" represents the length of the shorter side of the first inclined surface 814. "BL" represents the length of the cleaning blade 8 in the longitudinal direction. "R1" represents the radius of curvature of the second inclined surface 815. "R2" represents the radius of curvature of the first inclined surface 814. "FL" represents the height of the deflectable part 808. "P" represents the contact pressure with which the cleaning blade 8 contacts the photosensitive drum 1.

TABLE 7

| | d (mm) | BH (mm) | XL (μm) | XS (μm) | BL (mm) | R1 (mm) | R2 (mm) | FL (mm) | P (gf/cm$^2$) |
|---|---|---|---|---|---|---|---|---|---|
| Comparison Example | 1.6 | 12.0 | — | — | 238 | — | — | 7 | 9.5 |
| Example 4-1 | 1.6 | 12.0 | 1697.4 | 9.5 | 238 | 0.2 | — | 7 | 20.1 |
| Example 4-2 | 1.6 | 12.0 | 1697.4 | 9.5 | 238 | 0.2 | 203 | 7 | 19.6 |

Figure 22A:
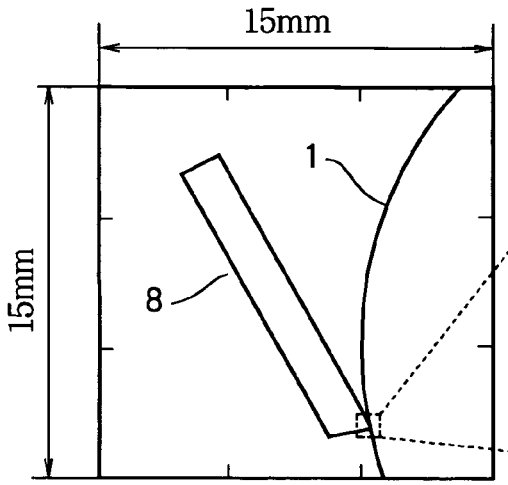
FIG. 22A is a schematic view showing a positional relationship between the cleaning blade of Example 4-1 and the photosensitive drum based on structural analysis.
Figure 22B:
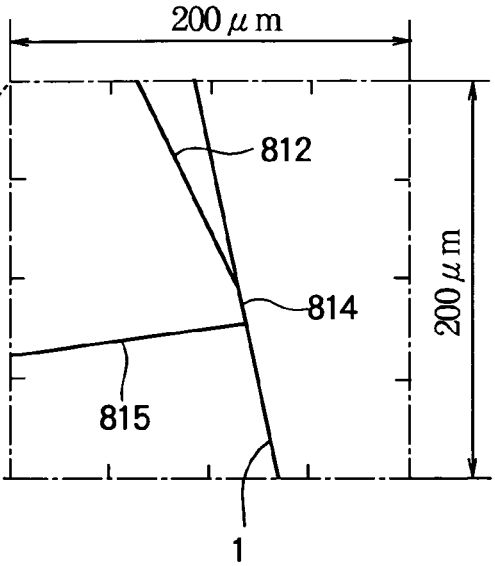
FIG. 22B is an enlarged schematic view showing a part in FIG. 22A.
Figure 23A:
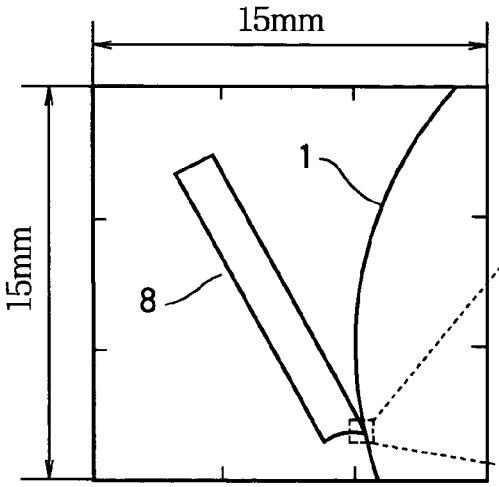
FIG. 23A is a schematic view showing a positional relationship between the cleaning blade of Example 4-2 and the photosensitive drum based on structural analysis.
Figure 23B:
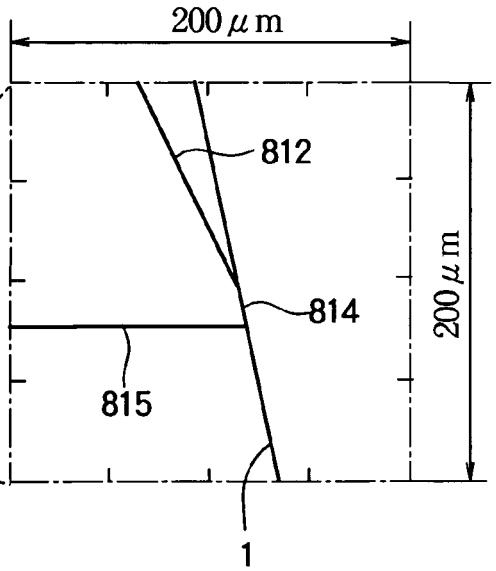
FIG. 23B is an enlarged schematic view showing a part in FIG. 23A.

The first inclined surface 814 of the cleaning blade 8 is convexly curved in order to increase contact pressure with which the tip of the cleaning blade 8 contacts the photosensitive drum 1. FIG. 22A schematically shows positional relationship between the cleaning blade 8 of Example 4-1 (FIGS. 18A and 18B) and the photosensitive drum 1 based on structural analysis. FIG. 22B shows a contact portion between the tip of the cleaning blade 8 (shown in FIG. 22A) and the photosensitive drum 1 in an enlarged scale. FIG. 23A schematically shows positional relationship between the cleaning blade 8 of Example 4-2 (FIGS. 19A and 19B) and the photosensitive drum 1 based on structural analysis. FIG. 23B shows a contact portion between the tip of the cleaning blade 8 (shown in FIG. 23A) and the photosensitive drum 1 in an enlarged scale.

The cleaning blade 8 manufactured as described above is mounted in the developing device shown in FIG. 2 in such a manner that the contact pressure P as shown in TABLE 7 is obtained, and printing test is performed. Conditions of the printing test are the same as those described in relation to Examples 1-1 to 1-3. The evaluation result is shown in TABLE 8.

TABLE 8

| | EVALUATION RESULT |
|---|---|
| Comparison Example | X |
| Example 4-1 | ○ |
| Example 4-2 | ○ |

The printing test is performed on 30000 recording sheets 14 under the same conditions as those described in relation to Examples 1-1 to 1-3. As a result, the cleaning blades 8 of Examples 4-1 and 4-2 (each of which has the first inclined surface 814 convexly curved) exhibit excellent cleaning performance.

As described above, the cleaning device according to Embodiment 4 includes a cleaning blade 8 provided so as to contact the image bearing body (i.e., the photosensitive drum 1 that bears a developer image) for scraping the developer adhering to the image bearing body. The cleaning blade 8 has at least two surfaces (i.e., the inclined surfaces 814 and 815) disposed on the edge portion 809 and having different lengths in a direction perpendicular to the longitudinal direction of the cleaning blade 8 (i.e., having different areas), and the smaller surface (i.e., the first inclined surface 814) contacts the image bearing body. In addition, the surface (i.e., the first inclined surface 814) contacting the image bearing body is convexly curved. Using such a cleaning device, excellent cleaning performance can be obtained.

In the above described embodiments, the cleaning device has been described as been used in the printer. However, the cleaning device according to the present invention is applicable to a multiple function peripheral (MFP), a facsimile machine or a copy machine or the like.

While the preferred embodiments of the present invention have been illustrated in detail, it should be apparent that modifications and improvements may be made to the invention without departing from the spirit and scope of the invention as described in the following claims.

What is claimed is:

1. A cleaning device comprising:

a blade disposed so as to contact an image bearing body that bears a developer image, said blade scraping off a developer adhering to said image bearing body, wherein said blade has an edge portion including first and second surfaces, and is configured so that a distance between said first and second surfaces decreases toward a tip of said edge portion, said first and second surfaces forming a predetermined edge angle at said tip of said edge portion, and wherein an area of said first surface is smaller than an area of said second surface, and said first surface contacts said image bearing body.

2. The cleaning device according to claim 1, wherein at least one of said first and second surfaces is curved in a cross section perpendicular to a longitudinal direction of said edge portion of said blade.

3. The cleaning device according to claim 2, wherein at least one of said first and second surfaces is concavely curved in said cross section.

4. The cleaning device according to claim 2, wherein at least one of said first and second surfaces is convexly curved in said cross section.

5. The cleaning device according to claim 2, wherein said second surface is concavely curved in said cross section.

6. The cleaning device according to claim 2, wherein said first surface is concavely curved in said cross section.

7. The cleaning device according to claim 2, wherein said first surface is convexly curved in said cross section.

8. The cleaning device according to claim 1, wherein said edge angle between said first and second surfaces at said tip of said edge portion is in a range from 42° to 129°.

9. An image forming apparatus comprising said cleaning device according to claim 1.

* * * * *